US008057913B2

(12) United States Patent
Sugiura et al.

(10) Patent No.: US 8,057,913 B2
(45) Date of Patent: Nov. 15, 2011

(54) STEEL SHEET HAVING HIGH YOUNG'S MODULUS, HOT-DIP GALVANIZED STEEL SHEET USING THE SAME, ALLOYED HOT-DIP GALVANIZED STEEL SHEET, STEEL PIPE HAVING HIGH YOUNG'S MODULUS AND METHODS FOR MANUFACTURING THE SAME

(75) Inventors: Natsuko Sugiura, Kimitsu (JP); Naoki Yoshinaga, Kimitsu (JP); Shunji Hiwatashi, Kimitsu (JP); Manabu Takahashi, Kisarazu (JP); Koji Hanya, Kimitsu (JP); Nobuyoshi Uno, Ichihara (JP); Ryoichi Kanno, Kisarazu (JP); Akihiro Miyasaka, Nagoya (JP); Takehide Senuma, Okayama (JP)

(73) Assignee: Nippon Steel Corporation, Tokyo (JP)

( * ) Notice: Subject to any disclaimer, the term of this patent is extended or adjusted under 35 U.S.C. 154(b) by 1072 days.

(21) Appl. No.: 11/572,693

(22) PCT Filed: Jul. 27, 2005

(86) PCT No.: PCT/JP2005/013717

§ 371 (c)(1),
(2), (4) Date: Jan. 25, 2007

(87) PCT Pub. No.: WO2006/011503

PCT Pub. Date: Feb. 2, 2006

(65) Prior Publication Data

US 2008/0008901 A1 Jan. 10, 2008

(30) Foreign Application Priority Data

Jul. 27, 2004 (JP) ..... P2004-218132
Nov. 15, 2004 (JP) ..... P2004-330578
Jan. 27, 2005 (JP) ..... P2005-019942
Jul. 15, 2005 (JP) ..... P2005-207043

(51) Int. Cl.
*B32B 15/18* (2006.01)

(52) U.S. Cl. ..... 428/659; 148/306; 420/121

(58) Field of Classification Search ..... None
See application file for complete search history.

(56) References Cited

U.S. PATENT DOCUMENTS 5,461,770 A * 10/1995 Kumura
(Continued)

FOREIGN PATENT DOCUMENTS

EP 1327695 7/2003
(Continued)

OTHER PUBLICATIONS

Corresponding European Search Report dated Jan. 8, 2008 of application No. 05767035.8-2122.
(Continued)

*Primary Examiner* — Timothy Speer
*Assistant Examiner* — Adam Krupicka
(74) *Attorney, Agent, or Firm* — Dorsey & Whitney LLP

(57) ABSTRACT

One aspect of the steel sheet having high Young's modulus includes in terms of mass %, C: 0.0005 to 0.30%, Si: 2.5% or less, Mn: 2.7 to 5.0%, P: 0.15% or less, S: 0.015% or less, Mo: 0.15 to 1.5%, B: 0.0006 to 0.01%, and Al: 0.15% or less, with the remainder being Fe and unavoidable impurities, wherein one or both of {110}<223> pole density and {110}<111> pole density in the ⅛ sheet thickness layer is 10 or more, and a Young's modulus in a rolling direction is more than 230 GPa. Another aspect of the steel sheet having high Young's modulus includes, in terms of mass %, C: 0.0005 to 0.30%, Si: 2.5% or less, Mn: 0.1 to 5.0%, P: 0.15% or less, S: 0.015% or less, Al: 0.15% or less, N: 0.01% or less, and further comprises one or two or more of Mo: 0.005 to 1.5%, Nb: 0.005 to 0.20%, Ti: at least 48/14×N (mass %) and 0.2% or less, and B: 0.0001 to 0.01%, at a total content of 0.015 to 1.91 mass %, with the remainder being Fe and unavoidable impurities, wherein the {110}<223> pole density and/or the {110}<111> pole density in the ⅛ sheet thickness layer is 10 or more, and a Young's modulus in a rolling direction is more than 230 GPa.

10 Claims, 1 Drawing Sheet

U.S. PATENT DOCUMENTS

2003/0196735 A1* 10/2003 Sugiura et al.

FOREIGN PATENT DOCUMENTS

| | | | |
|---|---|---|---|
| EP | 1362930 | | 11/2003 |
| EP | 1681363 | | 7/2006 |
| JP | 59083721 | * | 5/1984 |
| JP | 04136120 | * | 5/1992 |
| JP | 04141519 | * | 5/1992 |
| JP | 04143216 | * | 5/1992 |
| JP | 04147916 | * | 5/1992 |
| JP | 04147917 | * | 5/1992 |
| JP | 04293719 | * | 10/1992 |
| JP | 04301060 | | 10/1992 |
| JP | 04314823 | * | 11/1992 |
| JP | 05255804 | * | 10/1993 |
| JP | 05263191 | * | 10/1993 |
| JP | 06269808 | * | 9/1994 |
| JP | 08283842 | * | 10/1996 |
| JP | 08311541 | * | 11/1996 |
| JP | 09053118 | * | 2/1997 |
| JP | 09-316619 | | 12/1997 |
| JP | 2002363695 | * | 12/2002 |
| JP | 20031312 | * | 1/2003 |
| JP | 200355739 | * | 2/2003 |
| JP | 2003-166035 | | 6/2003 |
| JP | 2003-253385 | | 9/2003 |
| WO | WO 03/031669 | | 4/2003 |

OTHER PUBLICATIONS

Office Action issued in Japanese Patent Application No. 2004-218132 mailed on Oct. 20, 2009 with an English translation.

* cited by examiner

STEEL SHEET HAVING HIGH YOUNG'S MODULUS, HOT-DIP GALVANIZED STEEL SHEET USING THE SAME, ALLOYED HOT-DIP GALVANIZED STEEL SHEET, STEEL PIPE HAVING HIGH YOUNG'S MODULUS AND METHODS FOR MANUFACTURING THE SAME

CROSS-REFERENCE TO RELATED APPLICATION(S)

The present application is a national phase application of International Application No. PCT/JP2005/013717 filed on Jul. 27, 2005, and claims priority from such International application pursuant to 35 U.S.C. §365. In addition, the present application claims priority from Japanese Application Nos. 2004-218132, 2004-330578, 2005-019942, and 2005-207043, filed on Jul. 27, 2004, Nov. 15, 2004, Jan. 27, 2005 and Jul. 15, 2005, respectively. Further, the present application relates to Japanese Application Nos. 2004-002622 and 2004-045728, filed on Jan. 8, 2004 and Feb. 23, 2004, respectively. The entire disclosures of the above-identified International and Japanese applications and all references cited in the specification are incorporated herein by reference.

TECHNICAL FIELD

The present invention relates to steel sheets having high Young's modulus, hot-dip galvanized steel sheets using the same, alloyed hot-dip galvanized steel sheets, and steel pipes having high Young's modulus, and methods for manufacturing these.

This application claims priority from Japanese Patent Application No. 2004-218132 filed on Jul. 27, 2004, Japanese Patent Application No. 2004-330578 filed on Nov. 15, 2004, Japanese Patent Application No. 2005-019942 filed on Jan. 27, 2005, and Japanese Patent Application No. 2005-207043 filed on Jul. 15, 2005, the contents of which are incorporated herein by reference.

BACKGROUND ART

Many reports have been made on technologies for raising the Young's modulus. Most of those have pertained to technologies for increasing the Young's modulus in the rolling direction (RD) and in the transverse direction (TD) perpendicular to the rolling direction (RD).

Patent Documents 1 through 9, for example, each discloses a technology for increasing the Young's modulus in the TD direction by carrying out pressure rolling in the $\alpha+\gamma_2$ phase region.

Patent Document 10 discloses a technology for increasing the Young's modulus in the TD direction by subjecting the surface layer to pressure rolling in a temperature of less than the $Ar_3$ transformation temperature.

On the other hand, technologies for increasing the Young's modulus in the transverse direction and simultaneously increasing the Young's modulus in the rolling direction also have been proposed. That is, Patent Document 11 proposes increasing both Young's moduli by carrying out rolling in a fixed direction as well as rolling in the transverse direction perpendicular to this direction. However, changing the rolling direction during the continuous hot-rolling processing of a thin-sheet noticeably compromises the productivity, and thus this is not practical.

Patent Document 12 discloses a technology related to cold-rolled steel sheets with a high Young's modulus, but in this case as well, the Young's modulus in the TD direction is high but the Young's modulus in the RD direction is not high.

Also, Patent Document 4 discloses a technology for increasing the Young's modulus by adding a composite of Mo, Nb, and B, but because the hot rolling conditions are completely different, the Young's modulus in the TD direction is high but the Young's modulus in the RD direction is not high.

As illustrated above, although conventionally steel sheets having "high Young's modulus" have existed, all of these were steel sheets with high Young's moduli in the rolling direction (RD) and the transverse direction (TD). Incidentally, the maximum width of a steel sheet is about 2 m, and thus, if the direction with the largest Young's modulus is the lengthwise direction of the member, then the steel sheet could not be any longer than it is wide. Consequently, a demand has existed for steel sheets with a high Young's modulus in the rolling direction that can serve as long members. Further, hot rolling in the $\alpha+\gamma$ region, in which fluctuations in the rolling reaction force readily occur, has been a prerequisite for the manufacturing methods, and this has caused a problem in the productivity.

When processing steel sheets into components for automobiles or construction, the ability of the steel sheet to fix into the proper shape is a major issue. For example, a steel sheet that has been bent tries to spring back to its original shape when the load is removed, and this may lead to the problem that a desired shape cannot be obtained. This problem has become even more pronounced as steel sheets have become stronger, and is an obstacle when high-strength steel sheets are to be adopted as components.

Patent Document 1: Japanese Unexamined Patent Application, First Publication No. S59-83721

Patent Document 2: Japanese Unexamined Patent Application, First Publication No. H5-263191

Patent Document 3: Japanese Unexamined Patent Application, First Publication No. H8-283842

Patent Document 4 Japanese Unexamined Patent Application, First Publication No. H8-311541

Patent Document 5: Japanese Unexamined Patent Application, First Publication No. H9-53118

Patent Document 6 Japanese Unexamined Patent Application, First Publication No. H4-136120

Patent Document 7-Japanese Unexamined Patent Application, First Publication No. H4-141519

Patent Document 8: Japanese Unexamined Patent Application, First Publication No. H4-147916

Patent Document 9: Japanese Unexamined Patent Application, First Publication No. H4-293719

Patent Document 10: Japanese Unexamined Patent Application, First Publication No. H4-143216

Patent Document 11: Japanese Unexamined Patent Application, First Publication No. H4-147917

Patent Document 12 Japanese Unexamined Patent Application, First Publication No. H5-255804

DISCLOSURE OF INVENTION

Problems to be Solved by the Invention

The present invention was arrived at in light of the foregoing matters, and it is an object thereof to provide a steel sheet having high Young's modulus that has an excellent Young's modulus in the rolling direction (RD direction), and a hot-dip galvanized steel sheet using the same, an alloyed hot-dip galvanized steel sheet, a steel pipe having high Young's modulus, and methods for manufacturing these.

Means for Solving the Problems

The keen research conducted by the inventors for the purpose of achieving the foregoing objects lead to the unconventional findings discussed below.

That is, by developing a predetermined texture near the surface of a steel that contains a predetermined amount of C, Si, Mn, P, S, Mo, B and Al, or C, Si, Mn, P, S, Mo, B, Al, N, Nb, and Ti, the inventors were successful in attaining a steel sheet with a high Young' modulus in the rolling direction.

The steel sheet that is obtained through the invention has a particularly high Young' modulus of 240 GPa or more near its surface and thus has noticeably improved bend formability, and for example, its shape fixability also is noticeably improved. The reason behind why the increase in strength results in more shape fix defects such as spring back is that there is a large rebound when the weight that is applied during press deformation has been removed. Consequently, increasing the Young's modulus keeps the rebound down, and it becomes possible to reduce spring back. Additionally, since the deformation behavior near the surface layer, where the bend moment is large during bending deformation, noticeably affects the shape fixability, a noticeable improvement becomes possible by increasing the Young's modulus in the surface layer only.

The present invention is a completely novel steel sheet, and a method for manufacturing the same, that has been conceived based on the above concepts and novel findings and that is not found in the conventional art, and the gist of the invention is as follows.

(1) A steel sheet having high Young's modulus, that includes, in terms of mass %, C: 0.0005 to 0.30%, Si: 2.5% or less, Mn: 2.7 to 5.0%, P: 0.15% or less, S: 0.015% or less, Mo: 0.15 to 1.5%, B: 0.0006 to 0.01%, and Al: 0.15% or less, with the remainder being Fe and unavoidable impurities, wherein one or both of {110}<223> pole density and {110}<111> pole density in the ⅛ sheet thickness layer is 10 or more, and a Young's modulus in a rolling direction is more than 230 GPa.

(2) The steel sheet having high Young's modulus as described in (1), wherein the {112}<110> pole density in the ½ sheet thickness layer is 6 or more.

(3) The steel sheet having high Young's modulus as described in (1), which further includes one or two of Ti: 0.001 to 0.20 mass % and Nb: 0.001 to 0.20 mass %.

(4) The steel sheet having high Young's modulus as described in (1), wherein a BH amount (MPa), which is evaluated by the value obtained by subtracting a flow stress when stretched 2% from an upper yield point when, after stretched 2%, the steel sheet is heat treated at 170° C. for 20 minutes and then a tensile test is performed again, is in a range from 5 MPa or more to 200 MPa or less.

(5) The steel sheet having high Young's modulus as described in (1), which further includes Ca at 0.0005 to 0.01 mass %.

(6) The steel sheet having high Young's modulus as described in (1), which further includes one or two or more of Sn, Co, Zn, W, Zr, V, Mg, and REM at a total content of 0.001 to 1.0 mass %.

(7) The steel sheet having high Young's modulus as described in (1), which further includes one or two or more of Ni, Cu, and Cr at a total content of 0.001 to 4.0 mass %.

(8) A hot-dip galvanized steel sheet includes: the steel sheet having high Young's modulus as described in (1); and hot-dip zinc plating that is applied to the steel sheet having high Young's modulus.

(9) An alloyed hot-dip galvanized steel sheet includes: the steel sheet having high Young's modulus as described in (1); and alloyed hot-dip zinc plating that is applied to the steel sheet having high Young's modulus.

(10) A steel pipe hating high Young's modulus includes the steel sheet having high Young's modulus as described in (1), wherein the steel sheet having high Young's modulus is curled in any direction.

(11) A method for manufacturing the steel sheet having high Young's modulus as described in (1), includes heating a slab containing, in terms of mass %, C: 0.0005 to 0.30%, Si: 2.5% or less, Mn: 2.7 to 5.0%, P: 0.15% or less, S: 0.015% or less, Mo: 0.15 to 1.5%, B: 0.0006 to 0.01%, and Al: 0.15% or less, with the remainder being Fe and unavoidable impurities, at a temperature of 950° C. or more and subjecting the slab to hot rolling so as to obtain a hot rolled steel sheet, wherein the hot rolling is carried out under conditions where rolling is performed at 800° C. or less in such a manner that a coefficient of friction between the pressure rollers and the steel sheet is greater than 0.2 and the total of the reduction rates is 50% or more, and the hot rolling is finished at a temperature in a range from the $Ar_3$ transformation temperature or more to 750° C. or less.

(12) The method for manufacturing the steel sheet having high Young's modulus as described in (11), wherein in the hot rolling process, at least one pass of differential speed rolling at a different roll speeds ratio of 1% or more is conducted.

(13) The method for manufacturing the steel sheet having high Young's modulus as described in (11), wherein in the hot rolling process, pressure rollers whose roller diameter is 700 mm or less are used in one or more passes.

(14) The method for manufacturing the steel sheet having high Young's modulus as described in (11), which further includes annealing the hot rolled steel sheet after the hot rolling is finished, through a continuous annealing line or box annealing under the conditions in which a maximum attained temperature is in a range from 500° C. or more to 950° C. or less.

(15) The method for manufacturing the steel sheet having high Young's modulus as described in (11), which further includes: subjecting the hot rolled steel sheet after the hot rolling is finished to cold rolling at the reduction rate of less than 60%; and annealing after the cold rolling.

(16) The method for manufacturing the steel sheet having high Young's modulus as described in (11), which further includes: subjecting the hot rolled steel sheet to cold rolling at the reduction rate of less than 60%; annealing under the conditions in which a maximum attained temperature is in a range from 500° C. or more to 950° C. or less after the cold rolling; and cooling to 550° C. or less after the annealing and then performing thermal processing at 150 to 550° C.

(17) A method for manufacturing a hot-dip galvanized steel sheet, includes: manufacturing an annealed steel sheet having high Young's modulus by the method for manufacturing a steel sheet having high Young's modulus as described in (14); and subjecting the steel sheet having high Young's modulus to hot-dip galvanization.

(18) A method for manufacturing an alloyed hot-dip galvanized steel sheet, includes; manufacturing a hot-dip galvanized steel sheet by the method for manufacturing a hot-dip galvanized steel sheet as described in (17); and subjecting the hot-dip galvanized steel sheet to thermal processing in a temperature range of 450 to 600° C. for 10 seconds or more.

(19) A method for manufacturing a hot-dip galvanized steel sheet, includes: manufacturing an annealed steel sheet having high Young's modulus by the method for manufacturing a steel sheet having high Young's modulus as described in (15); and subjecting the steel sheet having high Young's modulus to hot-dip galvanization.

(20) A method for manufacturing an alloyed hot-dip galvanized steel sheet, includes: manufacturing a hot-dip galvanized steel sheet by the method for manufacturing a hot-dip galvanized steel sheet as described in (19); and subjecting the hot-dip galvanized steel sheet to thermal processing in a temperature range of 450 to 600° C. for 10 seconds or more.

(21) A method for manufacturing a steel pipe having high Young's modulus, includes: manufacturing a steel sheet having high Young's modulus by the method for manufacturing a steel sheet having high Young's modulus as described in (11); and curling the steel sheet having high Young's modulus in any direction so as to manufacture a steel pipe.

(22) A steel sheet having high Young's modulus, includes, in terms of mass %, C; 0.0005 to 0.30%, Si: 2.5% or less, Mn: 0.1 to 5.0%, P: 0.15 or less, S: 0.015% or less, Al: 0.15% or less, N: 0.01% or less; and further includes one or two or more of Mo: 0.005 to 1.5%, Nb: 0.005 to 0.20%, Ti: at least 48/14×N (mass %) and 0.2% or less, and B: 0.0001 to 0.01%, at a total content of 0.015 to 1.91 mass %, with the remainder being Fe and unavoidable impurities, wherein the {110}<223> pole density and/or the {110}<111> pole density in the ⅛ sheet thickness layer is 10 or more, and a Young's modulus in a rolling direction is more than 230 GPa.

(23) The steel sheet having high Young's modulus as described in (22), wherein the steel sheet includes all of Mo, Nb, Ti, and B, the respective contents are Mo: 0.15 to 1.5%, Nb: 0.01 to 0.20%, Ti: at least 48/14×N (mass %) and 0.2% or less, and B: 0.0006 to 0.01%; and the {110}<001> pole density in the ⅛ sheet thickness layer is 3 or less.

(24) The steel sheet having high Young's modulus as described in (22), wherein the {110}<001> pole density in the ⅛ sheet thickness layer is 6 or less.

(25) The steel sheet having high Young's modulus as described in (22), wherein the Young's modulus in the rolling direction is 240 GPa or more in at least a range from the surface layer to the ⅛ sheet thickness layer.

(26) The steel sheet having high Young's modulus as described in (22), wherein the {211}<011> pole density in the ½ sheet thickness layer is 6 or more.

(27) The steel sheet having high Young's modulus as described in (22), wherein the {332}<113> pole density in the ½ sheet thickness layer is 6 or more.

(28) The steel sheet having high Young's modulus as described in (22), wherein the {100}<011> pole density in the ½ sheet thickness layer is 6 or less.

(29) The steel sheet having high Young's modulus as described in (22), wherein a BR amount (MPa), which is evaluated by the value obtained by subtracting the flow stress when stretched 2% from an upper yield point when, after stretched 2%, the steel sheet is heat treated at 170° C. for 20 minutes and then a tensile test is performed again, is in a range from 5 MPa or more to 200 MPa or less.

(30) The steel sheet having high Young's modulus as described in (22), which further includes Ca: 0.0005 to 0.01 mass %.

(31) The steel sheet having high Young's modulus as described in (22), which further includes one or two or more of Sn, Co, Zn, W, Zr, V, Mg, and REM at a total content of 0.001 to 1.0 mass %.

(32) The steel sheet having high Young's modulus as described in (22), which further includes one or two or more of Ni, Cu, and Cr at a total content of 0.001 to 4.0 mass %.

(33) A hot-dip galvanized steel sheet includes: the steel sheet having high Young's modulus as described in (22), and hot-dip zinc plating that is applied to the steel sheet having high Young's modulus.

(34) An alloyed hot-dip galvanized steel sheet includes: the steel sheet having high Young's modulus as described in (22); and alloyed hot-dip zinc plating that is applied to the steel sheet having high Young's modulus.

(35) A steel pipe having high Young's modulus includes the steel sheet having high Young's modulus as described in (22), wherein the steel sheet having high Young's modulus is curled in any direction.

(36) A method for manufacturing the steel sheet having high Young's modulus as described in (22), includes; heating a slab containing, in terms of mass %, C: 0.0005 to 0.30%, Si: 2.5% or less, Mn: 0.1 to 5.0%, P: 0.15% or less, S: 0.015% or less, Al: 0.15% or less, N: 0.01% or less, and further containing one or two or more of Mo; 0.005 to 1.5%, Nb: 0.005 to 0.20%, Ti: at least 48/14×N (mass %) and 0.2% or less, and B: 0.0001 to 0.01%, at a total content of 0.015 to 1.91 mass %, with the remainder being Fe and unavoidable impurities, at a temperature of 1000° C. or more and subjecting the slab to hot rolling so as to obtain a hot rolled steel sheet, wherein in the hot rolling, the rolling is carried out in such a manner that a coefficient of friction between the pressure rollers and the steel sheet is greater than 0.2, an effective strain amount $\epsilon^*$ calculated by the following Formula [1] is 0.4 or more, and the total of the reduction rates is 50% or more, and the hot rolling is finished at a temperature in a range from the $Ar_3$ transformation temperature or more to 900° C. or less, $$\varepsilon^* = \sum_{j=1}^{n-1} \varepsilon_j \exp\left[-\sum_{i=j}^{n-1}\left(\frac{t_i}{\tau_i}\right)^{2/3}\right] + \varepsilon_n \quad [1]$$

in which n is the number of rolling stands of the finishing hot rolling, $\epsilon_j$ is the strain added at the j-th stand, $\epsilon_n$ is the strain added at the n-th stand, $t_i$ is the travel time (seconds) between the i-th and the i+1-th stands, and $\tau_i$ can be calculated by the following Formula [2] using the gas constant R (=1.987) and the rolling temperature $T_i$ (K) of the i-th stand.

$$\tau_i = 8.46\times10^{-9}\times\exp\{43800/R/T_i\} \quad [2]$$

(37) The method for manufacturing a steel sheet having high Young's modulus as described in (36), wherein in the hot rolling, at least one pass of differential speed rolling at a different roll speeds ratio of 1% or more is conducted.

(38) The method for manufacturing a steel sheet having high Young's modulus as described in (36), wherein in the hot rolling process, pressure rollers whose roller diameter is 700 mm or less are used in one or more passes.

(39) The method for manufacturing a steel sheet having high Young's modulus as described in (36), which further includes annealing the hot rolled steel sheet after the hot rolling is finished, through a continuous annealing line or box annealing under the conditions in which a maximum attained temperature is in a range from 500° C. or more to 950° C. or less.

(40) The method for manufacturing a steel sheet having high Young's modulus as described in (36), which further includes: subjecting the hot rolled steel sheet after the hot rolling is finished to cold rolling at the reduction rate of less than 60%; and annealing after the cold rolling.

(41) The method for manufacturing a steel sheet having high Young's modulus as described in (36), which further includes: subjecting the hot rolled steel sheet to cold rolling at the reduction rate of less than 60%; annealing under the conditions in which a maximum attained temperature is in a range from 500° C. or more to 950° C. or less after the cold rolling; and cooling to 550° C. or less after the annealing and then performing thermal processing at 150 to 550° C.

(42) A method for manufacturing a hot-dip galvanized steel sheet, includes: manufacturing an annealed steel sheet having high Young's modulus by the method for manufacturing a steel sheet having high Young's modulus as described in (39); and subjecting the steel sheet having high Young's modulus to hot-dip galvanization.

(43) A method for manufacturing an alloyed hot-dip galvanized steel sheet, includes: manufacturing a hot-dip galvanized steel sheet by the method for manufacturing a hot-dip galvanized steel sheet as described in (42); and subjecting the hot-dip galvanized steel sheet to thermal processing in a temperature range of 450 to 600° C. for 10 seconds or more.

(44) A method for manufacturing a hot-dip galvanized steel sheet, includes: manufacturing an annealed steel sheet having high Young's modulus by the method for manufacturing a steel sheet having high Young's modulus as described in (40); and subjecting the steel sheet having high Young's modulus to hot-dip galvanization.

(45) A method for manufacturing an alloyed hot-dip galvanized steel sheet, includes: manufacturing a hot-dip galvanized steel sheet by the method for manufacturing a hot-dip galvanized steel sheet as described in (44); and subjecting the hot-dip galvanized steel sheet to thermal processing in a temperature range of 450 to 600° C. for 10 seconds or more.

(46) A method for manufacturing a steel pipe having high Young's modulus, includes: manufacturing a steel sheet having high Young's modulus by the method for manufacturing a steel sheet having high Young's modulus as described in (36); and curling the steel sheet having high Young's modulus in any direction so as to manufacture a steel pipe.

Advantageous Effects of the Invention

In accordance with the steel sheet having high Young's modulus of the present invention, it becomes possible to develop the shear texture near the surface layer in the low-temperature γ region by defining the composition set forth in (1) or in (22). Further, adopting the texture set forth in (1) or in (22) allows an excellent Young's modulus to be achieved in the rolling direction (RD direction) in particular.

In accordance with the method for manufacturing a steel sheet having high Young's modulus of the present invention, it becomes possible to develop the shear texture near the surface layer in the low-temperature γ region by using a slab having the composition set forth in (11) or in (36). Further, by hot rolling under the conditions described above, it is possible to achieve the texture set forth in (1) or in (22), and a steel sheet with an excellent Young's modulus in the rolling direction (RD direction) in particular can be obtained.

BEST MODE FOR CARRYING OUT THE INVENTION

Figure 1:
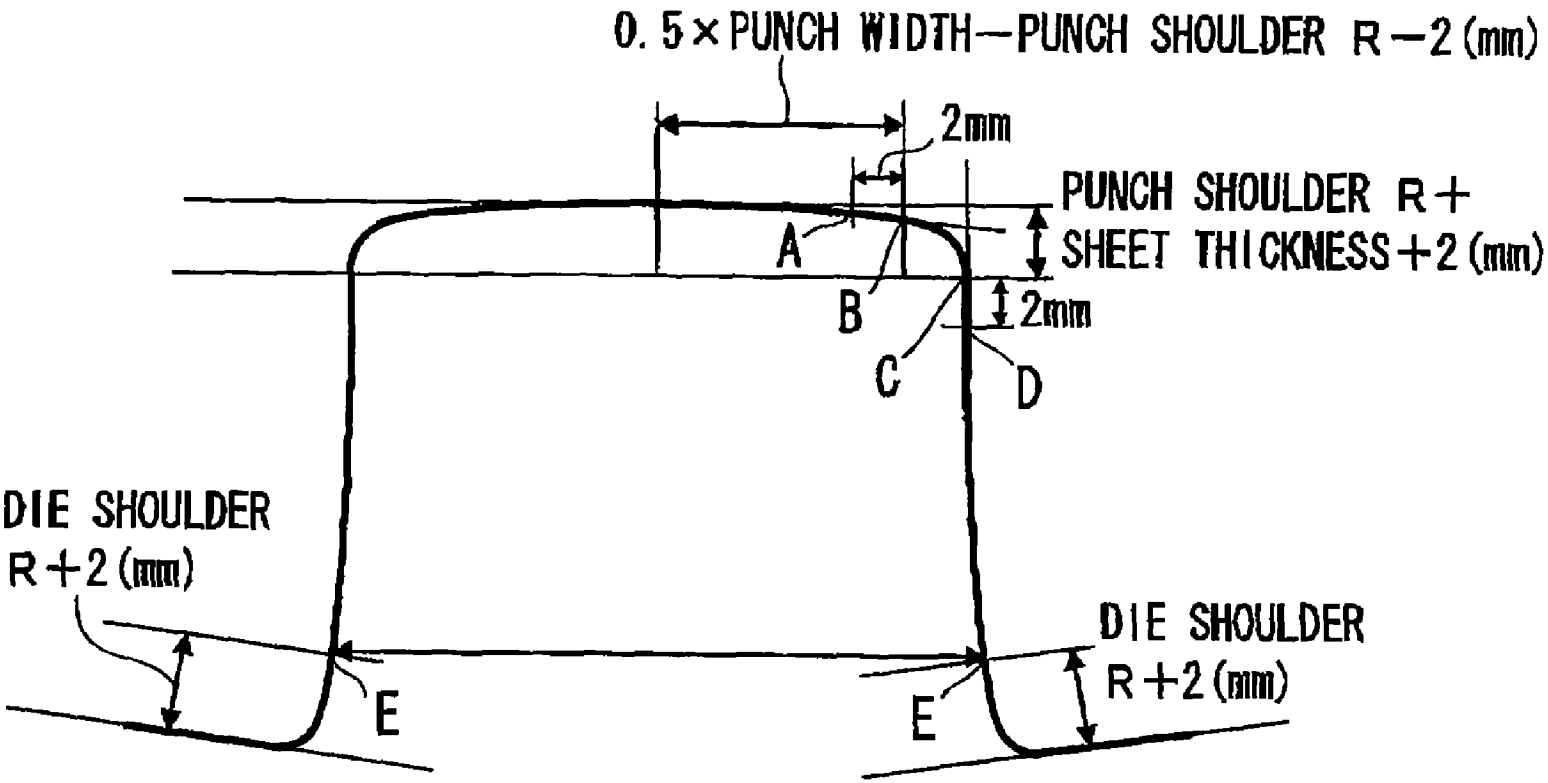
FIG. 1 is a cross-sectional view showing the test piece used in the hat shape bending test.

The reasons for limiting the steel composition and the manufacturing conditions as described above in the invention are explained below.

First Embodiment

The steel sheet of the first embodiment contains, in percent by mass, C: 0.0005 to 0.30%, Si: 2.5% or less, Mn: 2.7 to 5.0%, P: 0.15% or less, S: 0.015% or less, Mo: 0.15 to 1.5%, B: 0.0006 to 0.01%, and Al: 0.15% or less, and the remainder is Fe and unavoidable impurities. One or both of the {110} <223> pole density and the {110} <111> pole density in the ⅛ sheet thickness layer is 10 or more, and the Young's modulus in the rolling direction is more than 230 GPa.

C is an inexpensive element that increases the tensile strength, and thus the amount of C that is added is adjusted in accordance with the target strength level. When C is less than 0.0005 mass %, not only does the production of steel become technically difficult and cost most, but the fatigue properties of the welded sections become worse as well. Thus, 0.0005 mass % serves as the lower limit. On the other hand, a C amount above 0.30 mass % leads to a deterioration in moldability and adversely affects the weldability. Thus, 0.30 mass % serves as the upper limit.

Si not only acts to increase the strength as a solid solution strengthening element, but it also is effective for obtaining a structure that includes martensite or bainite as well as the residual γ, for example. The amount of Si that is added is adjusted according to the target strength level. When the amount added is greater than 2.5 mass % the press moldability becomes poor and leads to a drop in the chemical conversion. Thus, 2.5 mass % serves as the upper limit.

When hot-dip galvanization is conducted, Si causes problems such as lowering the plating adherence and lowering the productivity by delaying the alloying reaction, and thus it is preferable that Si is 1.2 mass % or less. Although no particular lower limits are set, production costs increase when the Si is 0.001 mass % or less, and thus the practical lower limit is above 0.001 mass %.

Mn is important in the present invention. That is to say, it is an element that is essential for obtaining a high Young's modulus. In the present invention, Mn can develop the Young's modulus in the rolling direction by developing the shear texture near the steel sheet surface layer in the low-temperature γ region. Mn stabilizes the γ phase and causes the γ region to expand down to low temperatures, thus facilitating low-temperature γ region rolling. Mn itself also may effectively act toward formation of the shear texture near the surface layer. From this standpoint, at least 2.7 mass % of Mn is added. On the other hand, when Mn is present at greater than 5.0 mass %, the strength becomes too high and lowers the ductility and hinders the ability of the zinc plating to adhere tightly. Thus, 5.0 mass % serves as the upper limit. Preferably this is 2.9 to 4.0 mass %.

P, like Si, is known to be an element that is inexpensive and increases strength, and in cases where it is necessary to increase the strength, additional P can be actively added. P also has the effect of achieving a finer hot rolled structure and improves the workability. However, when P is added at greater than 0.15 mass %, the fatigue strength after spot welding may become poor or the yield strength may increase too much and lead to surface shape defects when pressing. Further, when continuous hot-dip galvanization is performed, the alloying reaction becomes extremely slow, and this lowers the productivity. The secondary work embrittlement also becomes worse. Consequently, 0.15 mass % serves as the upper limit.

S, when present at greater than 0.015 mass %, becomes a cause of hot cracking and lowers the workability, and thus its upper limit is 0.015 mass %.

Mo and B are crucial to the present invention. It is not until these elements have been added that it becomes possible to increase the Young's modulus in the rolling direction. The reason for this is not absolutely clear, but it is believed that the effect of the combined addition of Mn, Mo and B changes the crystal rotation through shearing deformation that results from friction between the steel sheet and the hot roller. The result is that an extremely sharp texture is formed in the region from the surface layer of the hot rolling sheet down to about the ¼ sheet thickness layer, and this increases the Young's modulus in the rolling direction.

The lower limits of the amount of Mo and B are 0.15 mass % and 0.0006 mass %, respectively. This is because when added at amounts less than these, the effect of increasing the Young's modulus discussed above becomes small. On the other hand, when adding Mo and B more than 1.5 mass % and 0.01 mass %, respectively, it will not cause the effect of raising the Young's modulus to increase further and only increases costs, and thus 1.5 mass % and 0.01 mass % serve as the respective upper limits.

It should be noted that the effect of increasing the Young's modulus by simultaneously adding these elements can be further enhanced by combining them with C as well. Thus, it is preferable that the amount of C is 0.015 mass % or more.

Al can be used as a deoxidation regulator. However, since Al noticeably increases the transformation temperature and thus makes pressure rolling in the low-temperature γ region difficult, its upper limit is set to 0.15 mass %.

It is preferable that the steel sheet of the present embodiment contains Ti and Nb in addition to the components mentioned above. Ti and Nb have the effect of enhancing the effects of the Mn, Mo, and B discussed above to further increase the Young's modulus. They also are effective in improving the workability, increasing the strength, and making the structure finer and more uniform, and thus can be added as necessary. However, no effect is seen when these are added at less than 0.001 mass %, whereas the effects tend to plateau when these are added at more than 0.20 mass %, and thus this serves set as the upper limit. Preferably, these are present at 0.015 to 0.09 mass %.

Ca is useful as a deoxidizing element, and also exhibits an effect on the shape control of sulfides, and thus it can be added in a range of 0.0005 to 0.01 mass %. It does not have a sufficient effect when it is present at less than 0.0005 mass %, whereas it hampers the workability when it is added to greater than 0.01 mass %, and thus this range has been adopted.

A steel sheet that contains these as its primary components also may contain Sn, Co, Zn, W, Zr, Mg, and one or more REMs at a total content of 0.001 to 1 mass %. Here, REM refers to rare earth metal elements, and it is possible to select one or more from Sc, Y, La, Ce, Pr, Nd, Pm, Sm, Eu, Gd, Tb, Dy, Ho, Er, Tm, Yb, and Lu.

However, Zr forms ZrN and thus reduces the amount of solid solution N, and for this reason it is preferable that Zr is present at 0.01 mass % or less.

Ni, Cu, and Cr are useful elements for performing low-temperature γ region rolling, and one or two or more of these can be added at a combined total of 0.001 to 4.0 mass %. No noticeable effect is obtained when this is less than 0.001 mass %, whereas adding more than 4.0 mass % adversely affects the workability.

N is a γ-stabilizing element, and thus is a useful element for conducting low-temperature γ region rolling. Thus, it can be added up to 0.02 mass %. 0.02 mass % serves as the practical upper limit because addition beyond that makes manufacturing difficult.

It is preferable that the amount of solid solution N and the solid solution C each is from 0.0005 to 0.004 mass %. When a steel sheet that contains these is processed as a member component, strain aging occurs even at room temperature and raises the Young's modulus. For example, when the steel sheet is adopted in automobile applications, executing paint firing after processing increases not only the yield strength but also the Young's modulus of the steel sheet.

The amount of solid solution N and solid solution C can be found by subtracting the amount of C and N present (measured quantity from chemical analysis of the extract residue) as the compounds with Fe, Al, Nb, Ti, and B, for example, from the total C and N content. The amount also may be found using an internal friction method or FIM (Field Ion Microscopy).

When the solid solution C and N content is less than 0.0005 mass %, a sufficient effect cannot be attained. When this is greater than 0.004 mass %, the BH properties tend to become saturated and thus 0.004 mass % serves as the upper limit.

The texture, Young's modulus, and the BH content of the steel sheet are described next.

The {110} <223> pole density and/or the {110} <111> pole density in the ⅛ sheet thickness layer of the steel plate of the first embodiment is 10 or more. As a result, it is possible to increase the Young's modulus in the rolling direction. When the pole density is less than 10, it is difficult to increase the Young's modulus in the rolling direction to above 230 GPa. The pole density is preferably 14 or more, and more preferably 20 or more.

The pole density (X-ray random strength ratio) in these orientations can be found from the three dimensional texture (ODF) calculated by a series expansion method based on a plurality of pole figures from among the {110}, {100}, {211}, and {310} pole figures measured by X-ray diffraction. In other words, the pole densities of the various crystal orientations is represented by the strength of (110)[2-23] and (110) [1-11] in the $\phi 2=45°$ cross-section of the three-dimensional texture.

An example of how the pole density is measured is shown below.

The sample for X-ray diffraction was produced as follows.

A steel sheet was polished to a predetermined position in the sheet thickness direction through mechanical polishing or chemical polishing, for example. This polished surface was buffed into a mirror surface and then, while removing warping through electropolishing or chemical polishing, the thickness is adjusted so that the ⅛ layer thickness or the ½ layer thickness discussed later becomes the measured surface. For example, in the case of the ⅛ layer, when t serves as the thickness of the steel plate, then the steel plate surface is polished to a t/8 polishing thickness and the polished surface that is exposed serves as the measured surface. It should be noted that it is difficult to obtain a measured surface that is exactly ⅛ or ½ the sheet thickness, and thus it is sufficient to produce a sample whose measured surface is in a range of −3% to +3% the thickness of the target layer. Also, in cases where a segregation band is observed in the sheet thickness layer center layer of the steel sheet, it is possible to conduct measurement at a location where the segregation band does not exist, in a range of ⅜ to ⅝ sheet thickness. Further, in cases where X-ray measurement is difficult, it is possible to measure statistically significant values by EBSP or ECP.

The {hkl}<uvw> discussed above means that when the sample for X-ray is obtained as described above, the crystal orientation perpendicular to the sheet surface is <hkl> and the lengthwise direction of the steel sheet is <uvw>.

The characteristics of the texture of the steel sheet cannot be expressed by ordinary reverse pole figures or positive pole figures only, and for example, in a case where the reverse pole figure, which expresses the crystal orientation in the surface normal direction of the steel sheet, is measured near the ⅛ sheet thickness layer, then the surface strength ratio (X-ray random strength ratio) of the orientations is preferably <110>: 5 or more, and <112>: 2 or more. For the ½ sheet thickness layer, it is preferable that <112>: 4 or more, and <332>: 1.5 or more.

These limitations regarding the pole density are satisfied for at least the ⅛ sheet thickness layer, but it is preferable that these limitations are met not only for the ⅛ layer but also over a broad range up to the ¼ layer from the sheet thickness surface layer. Further, {110}<001> and {110}<110> are almost non-existent in the ⅛ sheet thickness layer, and their pole densities preferably are less than 1.5 and more preferably less than 1.0. In conventional steel sheets this orientation was present to a certain extent in the surface layer, and thus it was not possible to increase the Young's modulus in the rolling direction.

In the first embodiment, it is further preferable that the {112}<110> ((112)[1-10] in the φ2=45° cross-section of the ODF) pole density in the ½ sheet thickness layer is 6 or more. When this orientation is developed, the <111> orientation builds up in the transverse direction (hereinafter, also referred to as the TD direction) perpendicular to the rolling direction, and the Young's modulus in the TD direction increases as a result. It is difficult for the Young's modulus in the TD direction to exceed 230 GPa when this pole density is less than 6, and thus this serves as the lower limit. Preferably the pole density is 8 or more, and more preferably is 10 or more.

The {554}<225> and {332}<113> ((554)[−2-25] and (332)[−1-13] in the φ2=45° cross-section of the ODF) pole densities in the ½ sheet thickness layer can be expected to slightly contribute to the Young's modulus in the rolling direction, and thus preferably is 3 or more.

It should be noted that each of the crystal orientations discussed above permits variation within from −2.5° onward to within +2.5°.

By simultaneously meeting the criteria for the pole densities of the crystal orientations in the ⅛ sheet thickness layer and the ½ sheet thickness layer, it is possible to achieve a Young's modulus in both the rolling direction and the TD direction that exceeds 230 GPa.

The Young's modulus in the rolling direction of the steel sheet of the first embodiment is greater than 230 GPa. Measurement of the Young's modulus is performed by a lateral resonance method at room temperature in accordance with Japanese Industrial Standard JISZ2280 "High-Temperature Young's Modulus Measurement of Metal Materials". In other words, vibrations are applied from an external transmitter to a sample that is not fastened and is allowed to float, and the number of vibrations of the transmitter is changed gradually while the primary resonance frequency of the lateral resonance of the sample is measured, and from this the Young's modulus is calculated by Formula [3] below.

$$E=0.946\times(1/h)^3\times m/w\times f^2 \quad [3]$$

Here, E is the dynamic Young's modulus (N/m$^2$), 1 is the length (m) of the test piece, h is thickness (m) of the test piece, m is the mass (kg), w is the width (m) of the test piece, and f is the primary resonance frequency (sec$^{-1}$) of the lateral resonance method.

It is preferable that the BH amount of the steel sheet is 5 MPa or more. That is, this is because the measured Young's modulus increases when mobile dislocations are fixed by paint firing. This effect becomes poor when the BH amount is less than 5 MPa, and a superior effect is not observed when the BH amount exceeds 200 MPa. Thus, the range for the BH amount is set to 5 to 200 MPa. The BH amount is more preferably 30 to 100 MPa.

It should be noted that the BH amount is expressed by Formula [4] below, in which $\sigma_2$ (MPa) is the flow stress when the steel sheet has been stretched 2%, and $\sigma_1$ (MPa) is the upper yield point when, after the steel sheet has been stretched 2%, it is treated with heat at 170° C. for 20 minutes and then stretched again.

$$BH=\sigma_1-\sigma_2(\text{MPa}) \quad [4]$$

It should be noted that Al-based plating or various types of electroplating may be conducted on the hot-rolled steel sheets and the cold-rolled steel sheets. Depending on the objective, it is also possible to perform surface processing such as providing an organic film, an inorganic film, or various paints, on the hot-rolled steel sheets, the cold-rolled steel sheets, and the steel sheets obtained by subjecting these steel sheets to various types of plating.

The method for manufacturing the steel sheet of the first embodiment is described next.

The first embodiment includes heating a slab that contains, in percent by mass, C: 0.0005 to 0.30%, Si: 2.5% or less, Mn: 2.7 to 5.0%, P: 0.15% or less, S: 0.015% or less, Mo: 0.15 to 1.5%, B: 0.0006 to 0.01%, and Al: 0.15% or less, and the remainder being Fe and unavoidable impurities, at 950° C. or more and subjecting the slab to hot rolling to produce a hot-rolled steel sheet.

There are no particular limitations regarding the slab that is provided for this hot rolling. In other words, it is only necessary that it has been produced by a continuous casting slab or a thin slab caster, for example. The slat is also suited for a process such as continuous casting-direct rolling (CC-DR), in which hot rolling is performed immediately after casting.

To produce the hot-rolled steel sheet as a final product, it is necessary to limit the manufacturing conditions as follows.

The hot rolling heating temperature is set to 950° C. or more. This is the temperature required to set the hot-rolling finishing temperature mentioned later to the $Ar_3$ transformation temperature or more.

Hot rolling is performed so that the total of the reduction rates per pass at 800° C. or less is 50% or more. The coefficient of friction between the pressure rollers and the steel sheet at this time is greater than 0.2. This is an essential condition for developing the shearing texture of the surface layer so as to increase the Young's modulus in the rolling direction.

It is preferable that the total of the reduction rates is 70% or more, and more preferably 100% or more. The total of the reduction rates is defined as R1+R2+ . . . +Rn, in the case of n passes of pressure rolling, where R1 (%) through Rn (%) are the reduction rates from the first pass through the n-th pass. Rn={sheet thickness after (n−1)-th pass−sheet thickness after n-th pass}/sheet thickness after (n−1)-th pass×100(%).

The finishing temperature of the hot rolling is set in a range from the $Ar_3$ transformation temperature or more to 750° C. or less. When this is less than the $Ar_3$ transformation temperature, the {110}<001> texture is developed, and this is not favorable for the Young's modulus in the rolling direction.

When the finishing temperature is greater than 750° C., it is difficult to develop a favorable shearing texture in the rolling direction from the sheet thickness surface layer to near the ¼ sheet thickness layer.

There are no particular limitations regarding the curling temperature after the hot rolling, but since the Young's modulus increases when curling is performed at 400 to 600° C., it is preferable that curling is performed in this range.

When carrying out hot rolling, it is preferable that differential speed rolling in which the different roll speeds ratio between the pressure rollers is at least 1% is performed for at least one pass. Doing this promotes texture formation near the surface layer, and thus the Young's modulus can be increased more than in a case in which differential speed rolling is not performed. From this standpoint, it is preferable that differential speed rolling is performed at a different roll speeds ratio that is at least 1%, more preferably at least 5%, and most preferably at least 10%.

There are no particular restrictions regarding the upper limit for the different roll speeds ratio and the number of passes of differential speed rolling, but for the reasons mentioned above it goes without saying that when both of these is high, a large increase in the Young's modulus may be obtained. However, at the current time it is difficult to obtain a different roll speeds ratio greater than 50%, and ordinarily the number of finishing hot roll passes tops out at about 8 passes.

Here, the different roll speeds ratio in the present invention is the value obtained by dividing the difference in speed between the upper and lower pressure rollers by the speed of the slower roller, expressed as a percentage. As for the differential speed rolling of the present invention, there is no difference in the effect of increasing the Young's modulus regardless of whether it is the upper roller or the lower roller that has the greater speed.

It is preferable that at least one work roller whose roller diameter is 700 mm or less is used in the pressure rolling machine that is used for the finishing hot rolling. Doing this promotes texture formation near the surface layer and thus the Young's modulus can be increased more than in a case in which such a work roller is not used. From this standpoint, the work roller diameter is 700 mm or less, preferably 600 mm or less, and more preferably 500 mm or less. There are no particular restrictions regarding the lower limit of the work roller diameter, but the moving sheets cannot be controlled easily when this is below 300 mm. There are no restrictions regarding the upper limit to the number of passes in which a small diameter roller is used, but as mentioned previously, ordinarily the number of finishing hot roll passes is up to about 8 passes.

It is preferable that after the hot-rolled steel sheet that has been produced in this way is subjected to acid wash, it is subjected to thermal processing (annealing) at a maximum attained temperature in a range of 500 to 950° C. By doing this, the Young's modulus in the rolling direction is increased even further. The reason behind this is uncertain, but it is assumed that dislocations introduced by transformation after hot rolling are rearranged by the thermal processing.

When the maximum attained temperature is less than 500° C., the effect is not noticeable, whereas when it is greater than 950° C., an $\alpha \rightarrow \gamma$ transformation occurs, and as a result, the accumulation of the texture is the same or weaker and the Young's modulus also tends to become worse. Thus, 500° C. and 950° C. serve as the lower limit and the upper limit, respectively.

The range of the maximum attained temperature preferably is 650° C. to 850° C. There are no particular limitations regarding the method of the thermal processing, and it is possible to perform thermal processing through an ordinary continuous annealing line, box annealing, or a continuous hot-dip galvanization line, which is discussed later, for example.

It is also possible to subject the hot-rolled steel sheet to cold-rolling and thermal processing (annealing). The cold rolling rate is set to less than 60%. This is because when the cold rolling rate is set to 60% or more, the texture for increasing the Young's modulus that has been formed in the hot-rolled steel sheet changes significantly and lowers the Young's modulus in the rolling direction.

The thermal processing is performed after cold rolling is finished. The range of the maximum attained temperature of the thermal processing is 500° C. to 950° C. When the maximum attained temperature is less than 500° C., the increase in the Young's modulus is small and the workability may become poor, and thus 500° C. serves as the lower limit.

On the other hand, when the thermal processing temperature exceeds 950° C., an $\alpha \rightarrow \gamma$ transformation occurs, and as a result, the accumulation of texture is the same or weaker and the Young's modulus also tends to become worse. Thus, 500° C. and 950° C. serve as the lower limit and the upper limit, respectively. The preferable range of the maximum attained temperature is 600° C. to 850° C.

It is also possible to cool to 550° C. or less, preferably 450° C. or less, after the thermal processing and then to conduct further thermal processing at a temperature from 150 to 550° C. This can be carried out selecting appropriate conditions in accordance with various objectives, such as control of the solid solution C amount, tempering the martensite, and structural control such as promoting bainite transformation.

The structure of the steel sheet yielded by the method for manufacturing a steel sheet having high Young's modulus of this embodiment has ferrite or bainite as a primary phase, but both phases may be mixed together, and it is also possible for compounds such martensite, austenite, carbides, and nitrides to be present also. In other words, different structures can be created to meet the required characteristics.

Second Embodiment

The steel sheet of the second embodiment contains, in percent by mass, C: 0.0005 to 0.30%, Si: 2.5% or less, Mn: 0.1 to 5.0%, P: 0.15% or less, S: 0.015% or less, Al: 0.15% or less, N: 0.01% or less, and also contains one or two or more of Mo: 0.005 to 1.5%, Nb: 0.005 to 0.20%, Ti: 48/14×N (mass %) or more but less than 0.2%, and B: 0.0001 to 0.01%, at a total of 0.015 to 1.91 mass %, with the remainder being Fe and unavoidable impurities. The {110}<223> pole density and/or the {110}<111> pole density in the ⅛ sheet thickness layer is 10 or more. The Young's modulus in the rolling direction is greater than 230 GPa.

The reasons for limiting the steel composition as above are described here.

C is an inexpensive element that increases the tensile strength, and thus the amount of C that is added is adjusted in accordance with the target strength level. When C is less than 0.0005 mass %, not only does the production of steel become difficult and costs increase, but the fatigue properties of the welded sections become worse as well, and thus 0.0005 mass % serves as the lower limit. On the other hand, a C amount above 0.30 mass % leads to a deterioration in moldability and adversely affects the weldability, and thus 0.30 mass % serves as the upper limit.

Si not only acts to increase the strength as a solid solution strengthening element, but also is effective for obtaining a structure that includes martensite or bainite in addition to the residual y, for example. The amount of Si that is added is adjusted according to the target strength level. When the amount added is greater than 2.5 mass %, the pressing moldability becomes poor and the chemical conversion is lowered, and thus 2.5 mass % serves as the upper limit. It should be noted that when hot-dip galvanization is conducted, Si causes problems such as lowering the ability of the zinc plating to adhere tightly and lowering the productivity by delaying the alloying reaction, and thus it is preferable that Si is not more than 1.2 mass %. Although no particular lower limit has been set, production costs increase when Si is 0.001 mass % or less, and thus in practical terms this is the lower limit.

Mn stabilizes the γ phase and causes the γ region to expand even down to low temperatures, thus facilitating low-temperature γ region rolling. Mn itself also may effectively act to form the shear texture near the surface layer. Taking this into account, the amount of Mn added is preferably at least 0.1 mass %, more preferably at least 0.5 mass %, and yet more preferably at least 1.5 mass %. On the other hand, when Mn is present at greater than 5.0 mass %, the strength becomes too high and lowers the ductility and impairs the ability of the zinc plating to adhere closely, and thus 5.0 mass % serves as the upper limit. Thus, the amount of Mn added is preferably 2.9 to 4.0 mass %.

P, like Si, is known to be an inexpensive element that increases the strength, and in cases where increasing the strength is necessary, additional P can be actively added. P also has the effect of achieving a finer hot rolling structure and thereby improves the workability. However, when the amount added is greater than 0.15 mass %, the fatigue strength after spot welding is poor and the yield strength may increase too much and lead to surface shape defects when pressing. Further, when continuous hot-dip galvanization is performed, the alloying reaction becomes extremely slow, and this lowers the productivity. The secondary work embrittlement also becomes worse. Consequently, 0.15 mass % serves as the upper limit.

S, when present at greater than 0.015 mass %, may become a cause of hot cracking or lower the workability, and thus its upper limit is 0.015 mass %.

Mo, Nb, Ti, and B are important for the present invention. It is not until one or two or more of these elements have been added that it becomes possible to increase the Young's modulus in the rolling direction. The reason for this is not absolutely clear, but recrystallization during hot rolling is inhibited and the processed texture of the γ-phase becomes sharp, and as a result, a change occurs in the shearing-deformed texture due to friction between the steel sheet and the hot rollers as well. The result is that an extremely sharp texture is formed in the region from the sheet thickness surface layer of the hot-rolled sheet down to about the ¼ sheet thickness layer, increasing the Young's modulus in the rolling direction. The lower limits of the amount of Mo, Nb, Ti, and B are 0.005 mass %, 0.005 mass %, 48/14×N mass %, and 0.0001 mass %, respectively, preferably 0.03 mass %, 0.01 mass %, 0.03 mass %, and 0.0003 mass %, respectively, and more preferably 0.1 mass %, 0.03 mass %, 0.05 mass %, and 0.0006 mass %, respectively. This is because when added in smaller amounts, the effect of increasing the Young's modulus discussed above becomes small.

On the other hand, adding Mo, Nb, Ti, and B beyond 1.5 mass %, 0.2 mass %, 0.2 mass %, and 0.01 mass %, respectively, will not further increase the effect of raising the Young's modulus and only increases costs, and thus 1.5 mass %, 0.2 mass %, 0.2 mass %, and 0.01 mass % serve as the upper limits for the amount of Mo, Nb, Ti, and B, respectively, that is added.

When the total amount of these elements that has been added is less than 0.015 mass %, a sufficient Young's modulus increasing effect is not obtained, and thus 0.015 mass % serves as the lower limit of the total amount added. From this standpoint, it is preferable that the total amount added is at least 0.035 mass %, and more preferably at least 0.05 mass %. The upper limit of the total amount added is 1.91 mass %, which is the sum of the upper limits of the various added amounts.

Mo, Nb, Ti, and B interact with one another, and by adding these together, the texture becomes even stronger and the Young's modulus is increased further. From this, it is more preferable for at least two of these be added in combination. In particular, Ti forms nitrides with N in the γ high-temperature region, and inhibits the formation of BN. Thus, if B is to be added, it is preferable for Ti also to be added to at least 48/14×N mass %.

It is preferable that all of Mo, Nb, Ti, and B are present, and that these elements are added to at least 0.15 mass %, 0.01 mass %, 48/14×N mass %, and 0.0006 mass %, respectively. In this case, the texture becomes sharp, and in particular, {110}<001> of the surface layer, which lowers the Young's modulus, is reduced, effectively resulting in an increase in the Young's modulus. Thus, a high L-direction Young's modulus is attained.

It should be noted that the effect of increasing the Young's modulus that results from simultaneously adding these elements can be further enhanced by combining them with C as well. Thus, it is preferable that the amount of C is 0.015 mass % or more.

The lower limits for Mo, Nb, and B are 0.15 mass %, 0.01 mass %, and 0.0006 mass %, respectively. This is because adding these in an amount less than this reduces the effect of increasing the Young's modulus discussed above. However, if only the Young's modulus of the surface layer is to be controlled, then adding Mo to 0.1 mass % or more will allow a sufficient Young's modulus increasing effect to be obtained, and thus this serves as the lower limit. On the other hand, adding Mo, Nb, and B beyond 1.5 mass %, 0.2 mass %, and 0.01 mass %, respectively, will not result in a greater effect of raising the Young's modulus and only increases costs, and thus 1.5 mass %, 0.2 mass %, and 0.01 mass % serve as the respective upper limits.

It should be noted that the increase in the Young's modulus that results from simultaneously adding these elements can be further enhanced by combining them with C as well. Thus, it is preferable that the amount of C is 0.015 mass % or more.

Al can be used as a deoxidation regulator. However, since Al noticeably increases the transformation temperature and thus makes rolling in the low-temperature γ region difficult, its upper limit is set to 0.15 mass %. There are no particular limitations regarding the lower limit for Al, but from the standpoint of deoxidation, it is preferable that Al is present at 0.01 mass t or more.

N forms nitrides with B and lowers the effect of B in inhibiting recrystallization, and thus N is kept to 0.01 mass % or less. From this standpoint, preferably N is 0.005 mass % or less, and more preferably 0.002 mass % or less. No particular lower limit for N is set, but when less than 0.0005 mass % there is a diminished effect compared to the cost, and thus preferably the lower limit is 0.0005 mass % or more.

It is preferable that the amount of solid solution C is from 0.0005 to 0.004 mass %. When a steel sheet that contains C in solid solution is processed as a member component, strain aging occurs even at room temperature and raises the Young's modulus. For example, when the steel sheet is adopted for automobile applications, performing paint firing after processing increases not only the yield strength but also the Young's modulus of the steel sheet. The amount of solid solution C can be found by subtracting the amount of C present (measured quantity from chemical analysis of the extract residue) in the compounds with Fe, Al, Nb, Ti, and B, for example, from the total C content. The amount also may be found using an internal friction method or FIM (Field Ion Microscopy).

When the solid solution C is less than 0.0005 mass %, a sufficient effect cannot be attained. When greater than 0.004 mass %, the BH properties tend to saturate, and thus 0.004 mass % serves as the upper limit.

It is preferable that the steel sheet of the second embodiment includes Ca at 0.005 to 0.01 mass % in addition to the above composition.

Ca is useful as a deoxidizing element, and also has an effect on shape control of sulfides, and thus it can be added in a range of 0.005 to 0.01 mass %. It does not have a sufficient effect when it is present at less than 0.0005 mass %, whereas it decreases the workability when it is added to greater than 0.01 mass %, and thus this range has been chosen.

It is also possible for the steel sheet to contain Sn, Co, Zn, W, Zr, V, Mg, and one or more REMs for a total of 0.001 to 1% in percent by mass. In particular, W and V have the effect of inhibiting recrystallization of the γ region, and thus it is preferable that these are each added to at least 0.01 mass %. However, Zr forms ZrN and thus reduces the amount of solid solution N, and for this reason it is preferable that Zr is present at 0.01 mass % or less.

It is also possible to add one or two or more of Ni, Cu, and Cr for a combined total of 0.001 to 4.0% by mass.

When the total amount of Ni, Cu, and Cr added is less than 0.001 mass %, no noticeable effect is obtained, whereas the workability is adversely affected when these are added to greater than 4.0 mass %.

The texture, Young's modulus, and the BH content of the steel sheet are described next.

Regarding the texture of the steel sheet of the second embodiment, the {110} <223> pole density and/or the {110} <111> pole density in the ⅛ sheet thickness layer are 10 or more. As a result, it is possible to increase the Young's modulus in the rolling direction. When the pole density is less than 10, it is difficult to increase the Young's modulus in the rolling direction beyond 230 GPa. The pole density is preferably 14 or more, and more preferably 20 or more.

The pole density (X-ray random strength ratio) of these orientations can be found from the three dimensional texture (ODF) calculated by a series expansion method based on a plurality of pole figures from among the pole figures {110}, {100}, {211}, and {310} measured by X-ray diffraction. In other words, the pole density in these crystal orientations is expressed by the strength of (110) [2-23] and (110) [1-11] in the φ2=45° cross-section of the three-dimensional texture.

These pole densities are measured using the method that was described in the first embodiment.

The limitations regarding the pole density are satisfied for at least the ⅛ sheet thickness layer, but it is preferable that in practice these limitations are met not only for the ⅛ layer but also over a broad range from the sheet thickness surface layer up to the ¼ sheet thickness layer.

In the second embodiment, it is further preferable that the pole density in the {110}<110> orientation ((110) [001] in the φ2=45° cross-section of the ODF) in the ⅛ sheet thickness layer is 3 or less. Because this orientation noticeably lowers the Young's modulus in the rolling direction, when this orientation is greater than 3 it becomes difficult for the Young's modulus in the rolling direction to exceed 230 GPa. Factoring this into account, preferably the pole density is less than 3, and more preferably less than 1.5.

It is further preferable that the {211}<001> ((112) [1-10] in the φ2=45° cross-section of the ODF) pole density in the ½ sheet thickness layer is 6 or more. When this orientation is developed, the <111> orientation builds up in the transverse direction (TD direction), which is perpendicular to the rolling direction (RD direction), and thus the Young's modulus in the TD direction increases. It is difficult for the Young's modulus to exceed 230 GPa in the TD direction when this pole density is less than 6, and thus this serves as the lower limit. The preferable range for this pole density is 8 or more, and a more preferable range is 10 or more.

The {332}<113> ((332) [−1-13] in the φ2=45° cross-section of the ODF) pole density in the ½ sheet thickness layer can be expected to slightly contribute to the Young's modulus in the rolling direction. For this reason, it is preferable that the {332}<113> pole density in the ½ sheet thickness layer is 6 or more, more preferably 8 or more, and most preferably 10 or more.

The {110}<011> ((110) [1-10] in the φ2=45° cross-section of the ODF) pole density in the ½ sheet thickness layer noticeably lowers the Young's modulus in the 45° direction, and thus it is preferable that the pole density is set to 6 or less. The pole density of this orientation more preferably is 3 or less, and most preferably 1.5 or less.

It should be noted that each of the crystal orientations discussed above allows for variation within the range from −2.5° to +2.5°.

The characteristics of the texture of the steel sheet cannot be expressed by an ordinary reverse pole figure or a positive pole figure only, but, for example, in a case where the reverse pole figure, which expresses the crystal orientation in the surface normal direction of the steel sheet, has been measured near the ⅛ sheet thickness layer, the surface strength ratio (X-ray random strength ratio) of the various orientations is preferably <110>: 5 or more, and <112>: 2 or more. For the ½ layer, it is preferable that <112>: 4 or more, <332>: 4 or more, and <100>: 3 or less.

Regarding the Young's modulus of the steel sheet, by simultaneously satisfying the features for the pole density of the crystal orientation in the ⅛ sheet thickness layer and the ½ sheet thickness layer, it is possible to simultaneously achieve a Young's modulus that is beyond 230 GPa in not only the rolling direction (RD direction) but also in the direction perpendicular to the rolling direction, that is, the transverse (TD direction). For measurement of the Young's modulus, the method discussed in the first embodiment is adopted.

It is preferable that the lower limit value for the Young's modulus in the rolling direction in the ⅛ sheet thickness layer from the surface layer is 240 GPa. By doing this, a sufficient effect in improving the shape fixability is obtained. It is further preferable that the lower limit value for the Young's modulus in the rolling direction in the ⅛ layer from the surface layer is 245 GPa, and most preferably 250 GPa. There are no particular limitations regarding the upper limit value, but to exceed 300 GPa it is necessary to add a large quantity of other alloy elements, and other characteristics such as the workability become worse, and thus in practice the upper limit is 300 GPa or less. Even when the Young's modulus of the surface layer is greater than 240 GPa, a sufficient effect of improving the shape fixability is not attained when the thickness of this layer is less than ⅛ the sheet thickness. It should go without saying that the thicker a layer that has a high Young's modulus is, the higher the bend formability that is obtained.

It should be noted that the Young's modulus of the surface layer is measured by extracting a test piece at a thickness greater than ⅛ from the surface layer and performing the lateral resonance method discussed earlier.

There are no particular restrictions regarding the surface layer Young's modulus in the sheet transverse direction, but it should be apparent that a higher surface layer Young's modulus in the sheet transverse direction increases the bend formability in the transverse direction. By adopting a composition that contains all of Mo, Nb, Ti, and B as discussed above at Mo; 0.15 to 1.5%, Nb: 0.01 to 0.20%, Ti: 48/14×N (mass %) or more and 0.2% or less, and B: 0.0006 to 0.01%, with a texture in which the {110}<223> pole density and/or the {110}<111> pole density in the ⅛ sheet thickness layer are 10 or more and the pole density of {110}<001> in the ⅛ sheet thickness layer is 3 or less, the surface layer Young's modulus in the transverse direction also exceeds 240 GPa like in the rolling direction.

It is preferable that the BH amount of the steel sheet is 5 MPa or more. That is, this is because the Young's modulus in the rolling direction (RD direction) increases when the mobile dislocation is fixed by paint firing. This effect becomes poor when the BH amount is less than 5 MPa, and a greater effect is not observed when the BH amount exceeds 200 MPa. Thus, the range for the BH amount is set to 5 to 200 MPa. The BH amount is more preferably in a range of 30 to 100 MPa.

The BH amount is expressed by Formula [4], which was discussed in the first embodiment.

The method for manufacturing the steel sheet of the second embodiment is described next.

The second embodiment includes heating a slab that contains, in percent by mass, C: 0.0005 to 0.30%, Si: 2.5% or less, Mn: 0.1 to 5.0%, P: 0.15% or less, S: 0.015% or less, Mo: 0.15 to 1.5%, B: 0.0006 to 0.01%, Al: 0.15% or less, Nb: 0.01 to 0.20%, N: 0.01% or less, and Ti: 48/14×N (mass %) or more and 0.2% or less, with the remainder being Fe and unavoidable impurities, at a temperature of 1000° C. or more and subjecting the slab to hot rolling to produce a hot-rolled steel sheet.

There are no particular limitations regarding the slab that is supplied for this hot rolling. In other words, it is only necessary that it is a continuous casting slab or has been produced by a thin slab caster, for example. The slab is also suited for a process such as continuous casting-direct rolling (CC-DR), in which hot rolling is performed immediately after casting.

In this hot-rolling process, the hot rolling heating temperature is set to 1000° C. or more. The hot rolling heating temperature is set to 1000° C. or more. This is the temperature required to set the hot-rolling finishing temperature mentioned later to the $Ar_3$ transformation temperature or more.

Hot rolling is performed under the conditions in which a coefficient of friction is greater than 0.2 between the pressure rollers and the steel sheet, an effective strain amount $\epsilon^*$ calculated by Formula [5] below is 0.4 or more, and the total of the reduction rates is 50% or more. The above conditions are the essential conditions for developing the shear texture of the surface layer so as to increase the Young's modulus in the rolling direction.

$$\varepsilon^* = \sum_{j=1}^{n-1} \varepsilon_j \exp\left[-\sum_{i=j}^{n-1}\left(\frac{t_i}{\tau_i}\right)^{2/3}\right] + \varepsilon_n \quad [5]$$

Here, n is the rolling stand number of the finishing hot rolling, $\epsilon_j$ is the strain added at the j-th stand, $\epsilon_n$ is the strain added at the n-th stand, $t_i$ is the travel time (seconds) between the i-th and the (i+1)-th stands, and $\tau_i$ can be calculated by Formula [6] below using the gas constant R (=1.987) and the rolling temperature $T_i$ (K) of the i-th stand.

$$\tau_i = 8.46\times10^{-9}\times\exp\{43800/R/T_i\} \quad [6]$$

The total of the reduction rates RT can be calculated by Formula [7] below, where, in the case of n-number of passes of pressure rolling, R1 (%) through Rn (%) are the reduction rates from the first pass through the n-th pass.

$$RT = R1 + R2 + \ldots + Rn \quad [7]$$

However, it also can be expressed by Rn={sheet thickness after (n−1)-th pass−sheet thickness after n-th pass}/sheet thickness after (n−1)-th pass×100(%).

The effective strain amount $\epsilon^*$ is 0.4 or more, preferably 0.5 or more, and more preferably 0.6 or more. The total of the reduction rates is 50% or more, preferably 70% or more, and more preferably 100% or more.

The finishing temperature of the hot-rolling is set to a range from the $Ar_3$ transformation temperature or more to 900° C. or less.

When the finishing temperature is less than the $Ar_3$ transformation temperature, the {110}<001> texture is developed, and this is not favorable for the Young's modulus in the rolling direction. When the finishing temperature is greater than 900° C., it is difficult to develop a favorable shearing texture in the rolling direction from the sheet thickness surface layer to near the ¼ sheet thickness layer. From this standpoint, the finishing temperature for the hot rolling preferably is 850° C. or less, and more preferably 800° C. or less.

There are no particular limitations regarding the curling temperature after the hot rolling, but since the Young's modulus increases when curling is performed at 400 to 600° C., it is preferable that curling is performed in this range.

When carrying out hot rolling, it is preferable that differential speed rolling in which the different roll speeds ratio between the pressure rollers is at least 1% is performed for at least one pass. Doing this promotes texture formation near the surface layer, and thus the Young's modulus can be increased more than in a case in which differential speed rolling is not performed. From this standpoint, it is preferable that differential speed rolling is performed at a different roll speeds ratio that is at least 1%, more preferably at least 5%, and most preferably at least 10%.

There are no particular restrictions regarding the upper limit for the different roll speeds ratio and the number of passes of differential speed rolling, but for the reasons mentioned above it goes without saying that when both of these is high, the effect of a large increase in the Young's modulus is obtained. However, at the current time it is difficult to obtain a different roll speeds ratio greater than 50%, and ordinarily the number of finishing hot roll passes is up to about 8 passes.

Here, the different roll speeds ratio in the invention is the value obtained by dividing the difference in speed between the upper and lower pressure rollers by the speed of the slower roller, expressed as a percentage. As for the differential speed rolling of the present invention, there is no difference in the effect of increasing the Young's modulus regardless of whether it is the upper roller or the lower roller that has the greater speed.

It is preferable that at least one work roller whose roller diameter is 700 mm or less is used in the pressure rolling machine that is used for the finishing hot rolling. By doing this, texture formation near the surface layer is promoted, and thus the Young's modulus can be increased more than in a case in which such a work roller is not used. From this standpoint, the work roller diameter is 700 mm or less, preferably 600 mm or less, and more preferably 500 mm or less. There are no particular restrictions regarding the lower limit of the work roller diameter, but when it is below 300 mm it becomes difficult to control the moving sheets. There are no particular restrictions regarding the maximum number of passes in which the small diameter roller is used, but as mentioned above, ordinarily the number of finishing hot roll passes is up to about 8 passes.

It is preferable that once the hot-rolled steel sheet that has been manufactured in this way is subjected to acid wash, it is then subjected to thermal processing (annealing) with a maximum attained temperature in a range of 500 to 950° C. Thus, the Young's modulus in the rolling direction is increased even further. The reason behind this is unclear, but it is likely that dislocations introduced due to transformation after hot rolling are rearranged by thermal processing.

When the maximum attained temperature is less than 500° C., the effect is not noticeable, whereas an $\alpha \rightarrow \gamma$ transformation occurs when this is greater than 950° C., and as a result, the accumulation of texture is the same or worse and the Young's modulus tends to become worse as well. Thus, 500° C. and 950° C. serve as the lower limit and the upper limit, respectively.

The range of the maximum attained temperature preferably is 650° C. to 850° C.

There are no particular limitations regarding the method of the thermal processing, and it is possible to perform thermal processing through an ordinary continuous annealing line, box annealing, or a continuous hot-dip galvanization line, which is discussed later, for example.

It is also possible to perform cold-rolling and thermal processing (annealing) on the hot-rolled steel sheet after acid wash. The cold rolling rate is set to less than 60%. This is because when a cold rolling rate is set to 60% or more, the texture for increasing the Young's modulus that has been formed in the hot-rolled steel sheet is significantly altered and lowers the Young's modulus in the rolling direction.

The thermal processing is performed after cold rolling is finished. The maximum attained temperature of the thermal processing is in a range of 500° C. to 950° C. When the maximum attained temperature is less than 500° C., the increase in the Young's modulus is small and the workability may become poor, and thus 500° C. serves as the lower limit. On the other hand, an $\alpha \rightarrow \gamma$ transformation occurs when the thermal processing temperature exceeds 950° C., and as a result, the accumulation of texture is the same or weaker and the Young's modulus tends to become worse as well. Thus, 500° C. and 950° C. serve as the lower limit and the upper limit, respectively.

The preferable range of the maximum attained temperature is 600° C. to 850° C.

There is no particular limitation to the heating up rate towards the maximum attained temperature, but preferably this is in a range of 3 to 70° C./second. When the heating speed is under 3° C./second, recrystallization proceeds during heating and disrupts the texture that is effective in increasing the Young's modulus. Setting the heating up rate in excess of 70° C./second does not lead to a change in the superior material properties, and thus it is preferable that this value serves as the upper limit.

It is also possible to cool to 550° C. or less, preferably 450° C. or less, after the thermal processing and then to conduct thermal processing again at a temperature from 150 to 550° C. This can be carried out selecting appropriate conditions in accordance with various objectives, such as control of the solid solution C amount, tempering of the martensite, and structural control such as promoting bainite transformation.

The structure of the steel sheet that is produced by the method for manufacturing a steel sheet having high Young's modulus of this embodiment has ferrite or bainite as a primary phase, but both phases may be mixed together, and it is also possible for compounds such martensite, austenite, carbides, and nitrides to be present as well. In other words, different structures can be created to meet the required characteristics.

Third Embodiment

In the third embodiment, examples of a hot-dip galvanized steel sheet, an alloyed hot-dip galvanized steel sheet, and a steel pipe having high Young's modulus, that contain the steel sheets having high Young's modulus of the first and the second embodiments, and methods for manufacturing these, are described.

The hot-dip galvanized steel sheet has the steel sheet having high Young's modulus according to the first or the second embodiment, and hot-dip zinc plating that is conducted on that steel sheet having high Young's modulus. This hot-dip galvanized steel sheet is produced by subjecting the hot-rolled steel sheet after annealing that is obtained in the first and second embodiments, or a cold-rolled steel sheet obtained by performing cold rolling, to hot-dip galvanization.

There are no particular limitations regarding the composition of the zinc plating, and in addition to zinc it may also include Fe, Al, Mn, Cr, Mg, Pb, Sn, or Ni, for example, as necessary.

It should be noted that it is also possible to conduct thermal processing and zinc plating through a continuous hot-dip galvanization line after cold rolling.

The annealed hot-dip galvanized steel sheet has the steel sheet having high Young's modulus according to the first or the second embodiment, and the annealed hot-dip zinc plating that is applied to that steel sheet having high Young's modulus. This annealed hot-dip galvanized steel sheet is produced by annealing the hot-dip galvanized steel sheet.

The alloying is carried out by thermal processing within in a range of 450 to 600° C. The alloying does not proceed sufficiently when this is less than 450° C., whereas on the other hand, the alloying proceeds too much and the plating layer becomes brittle when this is greater than 600° C. This consequently leads to problems such as the plating peeling off due to pressing or other processing. Alloying is carried out for at least 10 seconds. Less than 10 seconds, alloying does not proceed sufficiently. It an alloyed hot-dip galvanized steel sheet is to be produced, it is also possible to perform acid wash as necessary after hot rolling and then conduct a skin pass of the reduction rate of 10% or less in-line or off-line.

The steel pipe having high Young's modulus is a steel pipe that contains a steel sheet having high Young's modulus according to the first or second embodiment, in which the steel sheet having high Young's modulus is curled in any direction. For example, the steel pipe having high Young's modulus may be produced by curling the steel sheet having high Young's modulus of the first or the second embodiment discussed above in such a manner that the rolling direction is a 0 to 30° angle with respect to the lengthwise direction of the steel pipe. By doing this, it is possible to produce a steel pipe having high Young's modulus in which the Young's modulus of the steel pipe in the lengthwise direction is high.

Since curling parallel to the rolling direction results in the highest Young's modulus, it is preferable that this angle is as small as possible. From this standpoint, it is particularly preferable that the sheet is curled at an angle that is 15° or less. As long as this relationship between the rolling direction and the lengthwise direction of the steel pipe is satisfied, any method may be employed to produce the pipe, including UO piping, seam welding, and spiraling. Of course, it is not necessary to limit the direction having the high Young's modulus to the direction parallel to the lengthwise direction of the steel pipe, and there is absolutely no problem with producing a steel pipe that has a high Young's modulus in a desired direction in accordance with the application.

It should be noted that it is also possible to subject the steel pipe having high Young's modulus to Al-based plating or various types of electrical plating. It is also possible to carry out surface processing, including forming an organic film, an inorganic film, or using various paints, on the hot-dip galvanized steel sheet, the alloyed hot-dip galvanized steel sheet, and the steel pipe having high Young's modulus, based on the objective to be achieved.

EXAMPLES

Next, the present invention is explained by examples.

Examples of the first and third embodiments are described below.

Example 1

Steel having the composition shown in Tables 1 and 2 was subjected to casting and hot rolling was performed under the conditions shown in Tables 3 and 4. The heating temperature at this time was 1250° C. in all cases. The final three stages in the finishing rolling stand, which had a total of seven stages, had a coefficient of friction between the rollers and the steel sheet in a range of 0.21 to 0.24, and the total of the reduction rates of the final three stages was 70%. In all cases, the skinpass rolling reduction rate was 0.3%.

The Young's modulus was measured by the lateral resonance method discussed earlier. A JIS 5 tension test piece was sampled, and the tension characteristics in the TD direction were evaluated. The texture in the ⅛ sheet thickness layer was also measured.

The results are shown in Tables 3 and 4. From these results, it is clear that by subjecting the steel that had the chemical composition of the present invention to hot rolling under the appropriate conditions, it was possible to achieve a Young's modulus greater than 230 GPa in the rolling direction.

Here, in the tables of the working examples, FT is the final finishing output temperature of the hot rolling, CT is the curling temperature, TS is the tensile strength, YS is the yield strength, E1 is the elongation, E(RD) is the Young's modulus in the RD direction, E(D) is the Young's modulus in a direction inclined at 45° relative to the RD direction, and E(TD) is the Young's modulus in the TD direction, I.E. represents inventive example, and C.E. represents comparative example. These indices are the same in the descriptions of subsequent tables as well.

TABLE 1

| Steel No. | C | Si | Mn | P | S | Al | N |
|---|---|---|---|---|---|---|---|
| A | 0.0040 | 0.01 | 3.01 | 0.010 | 0.0019 | 0.031 | 0.0024 |
| B | 0.0044 | 0.01 | 2.44 | 0.011 | 0.0022 | 0.028 | 0.0026 |
| C | 0.0036 | 0.01 | 1.95 | 0.008 | 0.0019 | 0.033 | 0.0031 |
| D | 0.0047 | 0.01 | 4.34 | 0.007 | 0.0025 | 0.029 | 0.0029 |
| E | 0.050 | 0.02 | 3.26 | 0.005 | 0.0034 | 0.022 | 0.0033 |

TABLE 1-continued

| Steel No. | C | Si | Mn | P | S | Al | N |
|---|---|---|---|---|---|---|---|
| F | 0.051 | 0.02 | 3.33 | 0.005 | 0.0037 | 0.027 | 0.0032 |
| G | 0.050 | 0.01 | 2.27 | 0.006 | 0.0034 | 0.030 | 0.0030 |
| H | 0.055 | 0.55 | 3.58 | 0.007 | 0.0016 | 0.024 | 0.0025 |
| I | 0.103 | 0.09 | 3.04 | 0.011 | 0.0020 | 0.035 | 0.0027 |
| J | 0.112 | 0.84 | 3.00 | 0.010 | 0.0020 | 1.660 | 0.0034 |
| K | 0.100 | 0.08 | 3.04 | 0.009 | 0.0018 | 0.032 | 0.0028 |
| L | 0.010 | 0.22 | 3.63 | 0.005 | 0.0027 | 0.037 | 0.0026 |
| M | 0.009 | 0.04 | 3.50 | 0.009 | 0.0031 | 0.031 | 0.0034 |
| N | 0.011 | 0.01 | 0.52 | 0.022 | 0.0053 | 0.033 | 0.0019 |

TABLE 2

| Steel No. | Mo | B | Ti | Nb | Others | $Ar_3$ (° C.) | Remarks |
|---|---|---|---|---|---|---|---|
| A | 0.28 | 0.0025 | — | — | — | 630 | Inventive steel |
| B | 0.25 | 0.0016 | 0.011 | 0.008 | — | 690 | Comparative steel |
| C | 0.17 | 0.0033 | 0.022 | — | — | 712 | Comparative steel |
| D | 0.29 | 0.0022 | 0.009 | 0.013 | — | 526 | Inventive steel |
| E | 0.52 | 0.0020 | 0.030 | 0.040 | — | 582 | Inventive steel |
| F | — | — | 0.029 | 0.038 | — | 649 | Comparative steel |
| G | 0.53 | 0.0024 | 0.025 | 0.041 | — | 656 | Comparative steel |
| H | 0.36 | 0.0037 | 0.014 | 0.022 | Cr = 0.40 | 560 | Inventive steel |
| I | 0.40 | 0.0019 | 0.018 | 0.019 | — | 599 | Inventive steel |
| J | 0.39 | 0.0020 | 0.020 | 0.019 | — | 949 | Comparative steel |
| K | 0.41 | — | 0.021 | 0.044 | V = 0.010 | 627 | Comparative steel |
| L | 0.33 | 0.0041 | — | 0.028 | — | 558 | Inventive steel |
| M | 0.42 | 0.0030 | — | — | Cu = 0.42 | 571 | Inventive steel |
| N | — | — | — | — | — | 887 | Comparative steel |

TABLE 3

| Sample No. | Steel No. | FT (° C.) | CT (° C.) | TS (MPa) | YS (MPa) | El (%) | E(RD) (GPa) | E(D) (GPa) | E(TD) (GPa) | {110} <223> | {110} <111> | Remarks |
|---|---|---|---|---|---|---|---|---|---|---|---|---|
| 1 | A | 840 | 500 | 525 | 377 | 29 | 216 | 195 | 228 | 5 | 3 | C.E. |
| 2 | | 770 | 500 | 568 | 424 | 26 | 225 | 196 | 229 | 9 | 5 | C.E. |
| 3 | | 700 | 500 | 607 | 459 | 23 | 234 | 192 | 231 | 13 | 10 | I.E. |
| 4 | B | 880 | 400 | 491 | 354 | 30 | 220 | 202 | 226 | 5 | 4 | C.E. |
| 5 | | 700 | 400 | 563 | 495 | 13 | 209 | 190 | 229 | 8 | 5 | C.E. |
| 6 | | 580 | 400 | 722 | 683 | 7 | 198 | 195 | 218 | 2 | 3 | C.E. |
| 7 | C | 900 | 550 | 476 | 321 | 32 | 219 | 208 | 222 | 4 | 3 | C.E. |
| 8 | | 800 | 550 | 495 | 338 | 30 | 223 | 201 | 225 | 6 | 4 | C.E. |
| 9 | | 700 | 550 | 544 | 504 | 11 | 190 | 220 | 225 | 4 | 2 | C.E. |
| 10 | D | 800 | 650 | 550 | 412 | 26 | 223 | 197 | 240 | 8 | 5 | C.E. |
| 11 | | 740 | 600 | 572 | 429 | 25 | 242 | 194 | 236 | 16 | 15 | I.E. |
| 12 | | 680 | 500 | 609 | 460 | 21 | 242 | 189 | 243 | 23 | 19 | I.E. |
| 13 | E | 730 | 580 | 988 | 746 | 12 | 236 | 192 | 240 | 19 | 14 | I.E. |
| 14 | | 700 | 550 | 1003 | 728 | 11 | 242 | 195 | 240 | 22 | 16 | I.E. |
| 15 | | 550 | 400 | 1110 | 650 | 13 | 208 | 203 | 237 | 6 | 6 | C.E. |
| 16 | F | 790 | 600 | 925 | 688 | 12 | 215 | 204 | 230 | 4 | 3 | C.E. |
| 17 | | 710 | 550 | 977 | 651 | 13 | 224 | 199 | 232 | 6 | 4 | C.E. |
| 18 | | 600 | 400 | 1046 | 622 | 14 | 195 | 193 | 229 | 4 | 3 | C.E. |
| 19 | G | 850 | 550 | 910 | 763 | 14 | 221 | 211 | 228 | 5 | 3 | C.E. |
| 20 | | 760 | 550 | 934 | 779 | 13 | 217 | 212 | 224 | 4 | 3 | C.E. |
| 21 | | 720 | 550 | 951 | 807 | 13 | 220 | 204 | 222 | 4 | 3 | C.E. |
| 22 | H | 800 | 650 | 1243 | 1089 | 9 | 228 | 196 | 241 | 8 | 6 | C.E. |
| 23 | | 690 | 550 | 1286 | 1101 | 8 | 248 | 191 | 243 | 26 | 22 | I.E. |
| 24 | | 650 | 500 | 1355 | 1162 | 7 | 251 | 186 | 245 | 30 | 23 | I.E. |

TABLE 4

| Sample No. | Steel No. | FT (° C.) | CT (° C.) | TS (MPa) | YS (MPa) | El (%) | E(RD) (GPa) | E(D) (GPa) | E(TD) (GPa) | {110} <223> | {110} <111> | Remarks |
|---|---|---|---|---|---|---|---|---|---|---|---|---|
| 25 | I | 850 | 500 | 1093 | 879 | 12 | 227 | 203 | 229 | 8 | 7 | C.E. |
| 26 | | 700 | 500 | 1152 | 926 | 11 | 242 | 194 | 239 | 20 | 15 | I.E. |
| 27 | | 650 | 500 | 1189 | 947 | 11 | 244 | 192 | 240 | 22 | 14 | I.E. |
| 28 | J | 950 | 700 | 774 | 478 | 19 | 218 | 213 | 223 | 4 | 3 | C.E. |
| 29 | | 800 | 650 | 881 | 595 | 17 | 197 | 195 | 231 | 3 | 2 | C.E. |
| 30 | | 700 | 550 | 1198 | 720 | 9 | 199 | 189 | 225 | 3 | 2 | C.E. |
| 31 | K | 850 | 550 | 1042 | 823 | 13 | 220 | 205 | 220 | 7 | 5 | C.E. |
| 32 | | 700 | 550 | 1090 | 901 | 12 | 226 | 199 | 235 | 7 | 6 | C.E. |
| 33 | | 650 | 550 | 1177 | 923 | 11 | 228 | 203 | 235 | 9 | 6 | C.E. |
| 34 | L | 740 | 600 | 754 | 627 | 17 | 239 | 197 | 236 | 16 | 11 | I.E. |
| 35 | | 700 | 550 | 772 | 652 | 16 | 243 | 192 | 241 | 21 | 18 | I.E. |
| 36 | | 650 | 500 | 806 | 679 | 15 | 250 | 182 | 239 | 29 | 19 | I.E. |
| 37 | M | 780 | 630 | 721 | 597 | 19 | 228 | 210 | 233 | 8 | 4 | C.E. |
| 38 | | 700 | 550 | 756 | 635 | 17 | 238 | 199 | 234 | 17 | 14 | I.E. |
| 39 | | 650 | 500 | 779 | 658 | 16 | 244 | 192 | 246 | 24 | 22 | I.E. |
| 40 | N | 910 | 700 | 334 | 188 | 48 | 215 | 211 | 224 | 4 | 4 | C.E. |
| 41 | | 800 | 650 | 329 | 165 | 50 | 218 | 207 | 225 | 3 | 3 | C.E. |
| 42 | | 700 | 550 | 378 | 276 | 41 | 207 | 198 | 238 | 4 | 3 | C.E. |

Example 2

The hot-rolled steel sheets E and L of Example 1 were subjected to continuous annealing (held at 700° C. for 90 seconds), box annealing (held at 700° C. for 6 hr), and continuous hot-dip galvanization (maximum attained temperature of 750° C.; alloying was performed at 550° C. for 20 seconds after immersion in a galvanization bath), and the tension characteristics and the Young's modulus were measured.

The results are shown in Table 5. From these results, it is clear that by subjecting steel that had the chemical composition of the present invention to hot rolling under suitable conditions, and then performing appropriate thermal processing, the Young's modulus was increased.

TABLE 5

| Sample No. | Steel No. | FT (° C.) | CT (° C.) | Processing after hot rolling | TS (MPa) | YS (MPa) | El (%) | BH (MPa) | E(RD) (GPa) | E(D) (GPa) | E(TD) (GPa) | {110} <223> | {110} <111> | Remarks |
|---|---|---|---|---|---|---|---|---|---|---|---|---|---|---|
| 43 | E | 700 | 550 | None | 1003 | 728 | 11 | 68 | 242 | 195 | 240 | 22 | 16 | I.E. |
| 44 | E | 700 | 550 | Continuous annealing | 980 | 751 | 11 | 95 | 245 | 196 | 242 | 20 | 17 | I.E. |
| 45 | E | 700 | 550 | Box annealing | 943 | 777 | 12 | 56 | 250 | 197 | 242 | 16 | 11 | I.E. |
| 46 | E | 700 | 550 | Continuous alloyed hot-dip galvanization | 966 | 722 | 12 | 74 | 244 | 196 | 243 | 19 | 15 | I.E. |

TABLE 5-continued

| Sample No. | Steel No. | FT (° C.) | CT (° C.) | Processing after hot rolling | TS (MPa) | YS (MPa) | El (%) | BH (MPa) | E(RD) (GPa) | E(D) (GPa) | E(TD) (GPa) | {110} <223> | {110} <111> | Remarks |
|---|---|---|---|---|---|---|---|---|---|---|---|---|---|---|
| 47 | L | 700 | 550 | None | 772 | 652 | 16 | 60 | 243 | 192 | 241 | 21 | 18 | I.E. |
| 48 | L | 700 | 550 | Continuous annealing | 745 | 614 | 18 | 89 | 248 | 193 | 243 | 19 | 16 | I.E. |
| 49 | L | 700 | 550 | Box annealing | 712 | 633 | 20 | 47 | 252 | 195 | 246 | 17 | 12 | I.E. |
| 50 | L | 700 | 550 | Continuous alloyed hot-dip galvanization | 739 | 620 | 19 | 66 | 249 | 195 | 242 | 18 | 15 | I.E. |

Example 3

The hot-rolled steel sheets E and L of Example 1 were subjected to cold rolling at the reduction rate of 30% and then were subjected to continuous hot-dip galvanization (the maximum attained temperature was variously changed, and after immersion in a galvanization bath, alloying was performed at 550° C. for 20 seconds), and the tension characteristics and the Young's modulus were measured.

The results are shown in Table 6. From these results, it is clear that by subjecting the steel that has the chemical composition of the present invention to hot rolling and cold rolling under suitable conditions, and then subjecting the steel to appropriate thermal processing, it is possible to obtain a cold-rolled steel sheet with excellent Young's moduli in both the RD direction and the TD direction. However, in cases where the maximum attained temperature was particularly high, there was a minor drop in the Young's modulus.

TABLE 6

| Sample No. | Steel No. | FT (° C.) | CT (° C.) | Cold rolling rate (%) | Maximum temperature (° C.) | TS (MPa) | YS (MPa) | El (%) | BH (MPa) | E(RD) (GPa) | E(D) (GPa) | E(TD) (GPa) | {110} <223> | {110} <111> | Remarks |
|---|---|---|---|---|---|---|---|---|---|---|---|---|---|---|---|
| 51 | E | 700 | 550 | 30 | 960 | 1058 | 784 | 10 | 53 | 231 | 194 | 233 | 11 | 8 | I.E. |
| 52 | E | 700 | 550 | 30 | 800 | 1181 | 695 | 13 | 94 | 237 | 198 | 235 | 14 | 10 | I.E. |
| 53 | E | 700 | 550 | 30 | 700 | 964 | 665 | 13 | 69 | 239 | 197 | 237 | 19 | 15 | I.E. |
| 54 | L | 700 | 550 | 30 | 970 | 810 | 679 | 15 | 57 | 231 | 199 | 232 | 11 | 7 | I.E. |
| 55 | L | 700 | 550 | 30 | 800 | 774 | 519 | 18 | 71 | 238 | 195 | 240 | 15 | 9 | I.E. |
| 56 | L | 700 | 550 | 30 | 700 | 711 | 536 | 18 | 65 | 240 | 194 | 239 | 16 | 11 | I.E. |

Example 4

The hot-rolled steel sheets E and L of Example 1 were subjected to the following processing.

The steel sheet was heated to 650° C. through a continuous hot-dip galvanization line and then cooled to approximately 470° C., thereafter it was immersed in a 460° C. hot-dip galvanization bath. The thickness of plate of the zinc on average was 40 g/m$^2$ one side. Subsequent to the hot-dip galvanization, the steel sheet surface was subjected to (1) organic film coating or (2) painting as described below, and the tension characteristics and the Young's modulus were measured.

The results are shown in Table 7. From these results, it can be clearly understood that the steel sheets that are subjected to hot-dip galvanization and the steel sheets that are subjected to hot-dip galvanization and have an organic film or paint applied to their surface have a good Young's modulus.

(1) Organic Film 4 mass % corrosion inhibitor and 12% colloidal silica were added to a water-borne resin in which the solid resin portion was 27.6 mass %, the dispersion liquid viscosity was 1400 mPa·s (25° C.), the pH was 8.8, the content of carboxyl group ammonium salts (—$COONH_4$) was 9.5 mass % of the total solid resin portion, the carboxyl group content was 2.5 mass % of the total solid resin portion, and the mean dispersion particle diameter was approximately 0.030 μm, so as to produce a rustproofing liquid. This rustproofing liquid was applied to the above steel sheet by a roll coater and dried to a 120° C. attained surface temperature of the steel sheet, so as to form an approximately 1-μm thick film.

(2) Paint

As a chemical treatment, a roll coater was used to apply "ZM1300AN" made by Nihon Parkerizing Co., Ltd. onto the above steel sheet after it had been degreased. Hot-air drying was performed so that the reached temperature of the steel sheet was 60° C. The amount of deposit of the chemical treatment was 50 mg/m$^2$ by Cr deposit. A primer paint was applied to one side of this chemically treated steel sheet, and a rear surface paint was applied to the other surface, using a roll coater. These were dried and hardened by an induction heater that includes the use of hot air. The temperature reached at this time was 210° C.

A top paint was then applied by a roller curtain coater to the surface on which the primer paint had been applied. This was dried and hardened by an induction heater that involves the use of hot air at a reached temperature of 230° C. It should be noted that the primer paint was applied at a dry film thickness of 5 μm using "FL640EU Primer" made by Japan Fine Coatings Co., Ltd. The rear surface paint was applied at a dry film thickness of 5 μm using "FL100HQ" made by Japan Fine Coatings Co., Ltd. The top paint was applied at a dry film thickness of 15 μm using "FL100HQ" made by Japan Fine Coatings Co., Ltd.

TABLE 7

| Sample No. | Steel No. | FT (° C.) | CT (° C.) | Surface processing | TS (MPa) | YS (MPa) | El (%) | E(RD) (GPa) | E(D) (GPa) | E(TD) (GPa) | {110} <223> | {110} <111> | Remarks |
|---|---|---|---|---|---|---|---|---|---|---|---|---|---|
| 57 | E | 700 | 550 | Hot-dip galvanization only | 1010 | 775 | 11 | 237 | 194 | 239 | 18 | 15 | I.E. |
| 58 | E | 700 | 550 | Organic film | 1016 | 763 | 11 | 240 | 196 | 240 | 19 | 14 | I.E. |
| 59 | E | 700 | 550 | Paint | 1042 | 822 | 10 | 245 | 200 | 243 | 18 | 15 | I.E. |
| 60 | L | 700 | 550 | Hot-dip galvanization only | 781 | 654 | 15 | 238 | 192 | 238 | 16 | 12 | I.E. |
| 61 | L | 700 | 550 | Organic film | 789 | 679 | 14 | 239 | 194 | 240 | 16 | 11 | I.E. |
| 62 | L | 700 | 550 | Paint | 838 | 707 | 13 | 247 | 203 | 246 | 17 | 12 | I.E. |

Example 5

The steels E and L shown in Table 1 were subjected to differential speed rolling. The different roll speeds rate was changed over the last three stages of the finishing rolling stand, which was constituted by a total of seven stages. The hot rolling conditions and the results of measuring the tension characteristics and the Young's modulus are shown in Table 8. It should be noted that the hot rolling conditions that are not shown in Table 8 are the same as those in Example 1.

It is clear from the results that the formation of texture near the surface layer is facilitated in the case in which one or more passes of differential speed rolling at 1% or more are added when hot rolling the steel having the chemical composition of the present invention under appropriate conditions, and this further increases the Young's modulus.

TABLE 8

| Sample No. | Steel No. | FT (° C.) | CT (° C.) | Different roll speeds ratio (%) 5th pass | 6th pass | 7th pass | TS (MPa) | YS (MPa) | El (%) | E(RD) (GPa) | E(D) (GPa) | E(TD) (GPa) | {110} <223> | {110} <111> | Remarks |
|---|---|---|---|---|---|---|---|---|---|---|---|---|---|---|---|
| 63 | E | 700 | 550 | 0 | 0 | 0 | 1003 | 728 | 11 | 242 | 195 | 240 | 22 | 16 | I.E. |
| 64 | E | 700 | 550 | 0 | 0 | 3 | 1005 | 733 | 11 | 245 | 193 | 240 | 24 | 18 | I.E. |
| 65 | E | 700 | 550 | 1 | 2 | 3 | 1011 | 729 | 10 | 247 | 188 | 242 | 25 | 19 | I.E. |
| 66 | E | 700 | 550 | 10 | 5 | 5 | 1009 | 731 | 12 | 253 | 186 | 246 | 31 | 25 | I.E. |
| 67 | L | 700 | 550 | 0 | 0 | 0 | 772 | 652 | 16 | 243 | 192 | 241 | 21 | 18 | I.E. |
| 68 | L | 700 | 550 | 3 | 3 | 3 | 773 | 655 | 15 | 245 | 189 | 242 | 24 | 18 | I.E. |
| 69 | L | 700 | 550 | 0 | 0 | 10 | 775 | 650 | 15 | 249 | 190 | 244 | 26 | 19 | I.E. |
| 70 | L | 700 | 550 | 0 | 20 | 20 | 772 | 653 | 15 | 256 | 186 | 248 | 31 | 26 | I.E. |

Example 6

The steels E and L shown in Table 1 were subjected to pressure rolling with small-diameter rollers. The roller diameter was changed in the last three stages of the finishing rolling stand, which is composed of seven stages in total. The hot rolling conditions and the results of measuring the tension characteristics and the Young's modulus are shown in Table 9. It should be noted that the hot rolling conditions that are not shown in Table 9 are all the same as those in Example 1.

It is clear from the results that the formation of texture near the surface layer is facilitated in the case in which rollers with a roller diameter of 700 mm or less are used in one or more passes when hot rolling the steel having the chemical composition of the present invention under appropriate conditions, and this further increases the Young's modulus.

TABLE 9

| Sample No. | Steel No. | FT (° C.) | CT (° C.) | Roller diameter (mm) 5th pass | 6th pass | 7th pass | TS (MPa) | YS (MPa) | El (%) | E(RD) (GPa) | E(D) (GPa) | E(TD) (GPa) | {110} <223> | {110} <111> | Remarks |
|---|---|---|---|---|---|---|---|---|---|---|---|---|---|---|---|
| 71 | E | 700 | 550 | 800 | 800 | 800 | 1003 | 728 | 11 | 242 | 195 | 240 | 22 | 16 | I.E. |
| 72 | E | 700 | 550 | 800 | 800 | 600 | 1011 | 736 | 10 | 246 | 190 | 242 | 24 | 19 | I.E. |
| 73 | E | 700 | 550 | 600 | 600 | 600 | 1009 | 725 | 11 | 251 | 187 | 244 | 28 | 21 | I.E. |
| 74 | E | 700 | 550 | 500 | 500 | 500 | 998 | 733 | 10 | 255 | 186 | 243 | 33 | 24 | I.E. |
| 75 | L | 700 | 550 | 800 | 800 | 800 | 772 | 652 | 16 | 243 | 192 | 241 | 21 | 19 | I.E. |
| 76 | L | 700 | 550 | 800 | 800 | 600 | 783 | 658 | 14 | 247 | 189 | 243 | 25 | 17 | I.E. |
| 77 | L | 700 | 550 | 600 | 600 | 600 | 779 | 655 | 15 | 250 | 188 | 242 | 27 | 20 | I.E. |
| 78 | L | 700 | 550 | 500 | 500 | 500 | 768 | 649 | 16 | 253 | 186 | 245 | 30 | 25 | I.E. |

Example 7

Next, examples pertaining to the second and the third embodiments are discussed below.

Steel having the compositions shown in Tables 10 to 13 are subjected to casting and hot rolling is performed under the conditions of Tables 14 to 19. In all cases, the heating temperature at this time was 1230° C. The coefficient of friction between the rollers and the steel sheet in the last three stages of the finishing rolling stand, which is composed of seven stages in total, was in a range of 0.21 to 0.24, and the total of the reduction rates of the last three stages was 55%. In all cases, the skinpass rolling reduction rate was 0.3%.

The Young's modulus was measured by the lateral resonance method discussed earlier. A JIS 5 tension test piece was sampled and the tension characteristics in the TD direction were evaluated. The texture in the ⅛ sheet thickness layer and the 7/16 sheet thickness layer was also measured.

The results are shown in Tables 14 through 19. It should be noted that Table 15 is a continuation of Table 14, and that Table 17 is a continuation of Table 16. Also, Table 19 is a continuation of Table 18. In one table and the table that is a continuation of that table, values in the same row indicate values for the same sample. The same applies for subsequent tables in the specification as well. Values that are underlined indicate values that are outside the range of the invention. This applies in the description of the subsequent tables as well.

From Tables 14 through 19 it can be understood that when the steel having the chemical composition of the present invention has been hot rolled under appropriate conditions, it is possible to achieve a Young's modulus in the rolling direction that is more than 230 GPa.

TABLE 10

| Steel No. | C | Si | Mn | P | S | Al | N | Mo | B |
|---|---|---|---|---|---|---|---|---|---|
| A | 0.0010 | 0.01 | 1.82 | 0.010 | 0.0023 | 0.036 | 0.0025 | 0.200 | 0.0010 |
| B | 0.0036 | 0.01 | 0.07 | 0.011 | 0.0019 | 0.042 | 0.0031 | 0.150 | 0.0008 |
| C | 0.038 | 0.01 | 2.98 | 0.007 | 0.0022 | 0.038 | 0.0042 | 0.300 | 0.0012 |
| D | 0.025 | 2.90 | 1.23 | 0.006 | 0.0035 | 0.035 | 0.0045 | 0.180 | 0.0001 |
| E | 0.050 | 0.02 | 0.52 | 0.007 | 0.0042 | 0.028 | 0.0036 | 0.250 | 0.0023 |
| F | 0.120 | 0.02 | 1.29 | 0.005 | 0.0023 | 1.050 | 0.0038 | 0.420 | 0.0016 |
| G | 0.055 | 0.01 | 2.30 | 0.006 | 0.0011 | 0.039 | 0.0038 | 0.010 | 0.0020 |
| H | 0.061 | 0.43 | 0.05 | 0.007 | 0.0016 | 0.045 | 0.0030 | 0.000 | 0.0002 |
| I | 0.011 | 0.42 | 0.51 | 0.012 | 0.0023 | 0.026 | 0.0045 | 0.004 | 0.0016 |
| J | 0.087 | 0.77 | 1.13 | 0.001 | 0.0025 | 0.035 | 0.0035 | 0.000 | 0.0000 |
| K | 0.102 | 0.03 | 2.35 | 0.021 | 0.0011 | 0.036 | 0.0036 | 0.320 | 0.0031 |
| L | 0.092 | 0.03 | 3.26 | 0.008 | 0.0016 | 0.036 | 0.0033 | 0.530 | 0.0018 |
| M | 0.053 | 0.22 | 2.05 | 0.009 | 0.0037 | 0.042 | 0.0042 | 0.000 | 0.0008 |
| N | 0.076 | 0.01 | 4.33 | 0.012 | 0.0025 | 0.038 | 0.0023 | 0.620 | 0.0016 |
| O | 0.032 | 0.06 | 3.50 | 0.010 | 0.0045 | 0.032 | 0.0021 | 0.000 | 0.0008 |
| P | 0.021 | 0.03 | 2.30 | 0.007 | 0.0036 | 0.033 | 0.0022 | 0.000 | 0.0012 |
| Q | 0.050 | 1.20 | 1.32 | 0.012 | 0.0087 | 0.042 | 0.0023 | 0.000 | 0.0011 |

TABLE 11

| Steel No. | Nb | Ti | Ti − 48/14 × N | Mo + Nb + B + Ti | Others | $Ar_3$ (° C.) | Remarks |
|---|---|---|---|---|---|---|---|
| A | 0.015 | 0.04 | 0.031 | 0.2560 | | 756 | Inventive steel |
| B | 0.023 | 0.025 | 0.014 | 0.1988 | | 903 | Comparative steel |
| C | 0.042 | 0.031 | 0.017 | 0.3742 | Cr: 0.2 | 641 | Inventive steel |
| D | 0.031 | 0.023 | 0.008 | 0.2341 | | 906 | Comparative steel |
| E | 0.023 | 0.023 | 0.011 | 0.2983 | | 820 | Inventive steel |
| F | 0.028 | 0.018 | 0.005 | 0.4676 | V: 0.04 | 995 | Comparative steel |
| G | 0.025 | 0.023 | 0.010 | 0.0600 | Cu: 0.3 | 701 | Inventive steel |
| H | 0.006 | 0.000 | −0.010 | 0.0062 | | 922 | Comparative steel |
| I | 0.006 | 0.230 | 0.215 | 0.2416 | | 876 | Comparative steel |
| J | 0.000 | 0.000 | −0.012 | 0.0000 | | 840 | Comparative steel |
| K | 0.044 | 0.042 | 0.030 | 0.4091 | | 688 | Inventive steel |
| L | 0.025 | 0.053 | 0.042 | 0.6098 | | 574 | Inventive steel |
| M | 0.004 | 0.004 | −0.010 | 0.0088 | Ca: 0.003 | 748 | Comparative steel |
| N | 0.014 | 0.029 | 0.021 | 0.6646 | | 563 | Inventive steel |
| O | 0.020 | 0.015 | 0.008 | 0.0358 | W: 0.03 | 643 | Inventive steel |
| P | 0.038 | 0.023 | 0.015 | 0.0622 | | 742 | Inventive steel |
| Q | 0.095 | 0.019 | 0.011 | 0.1151 | | 852 | Inventive steel |

TABLE 12

| Steel No. | C | Si | Mn | P | S | Al | N | Mo | B |
|---|---|---|---|---|---|---|---|---|---|
| R | 0.032 | 0.80 | 3.20 | 0.008 | 0.0042 | 0.031 | 0.0021 | 0.012 | 0.0006 |
| S | 0.048 | 0.30 | 1.57 | 0.010 | 0.0110 | 0.035 | 0.0018 | 0.036 | 0.0008 |
| T | 0.027 | 0.02 | 1.10 | 0.013 | 0.0078 | 0.042 | 0.0013 | 0.105 | 0.0003 |
| U | 0.036 | 0.50 | 2.05 | 0.008 | 0.0032 | 0.044 | 0.0023 | 0.520 | 0.0006 |
| V | 0.042 | 0.02 | 1.52 | 0.011 | 0.0051 | 0.023 | 0.0025 | 0.080 | 0.0021 |
| W | 0.033 | 0.60 | 0.97 | 0.006 | 0.0066 | 0.033 | 0.0020 | 0.020 | 0.0025 |

TABLE 12-continued

| Steel No. | C | Si | Mn | P | S | Al | N | Mo | B |
|---|---|---|---|---|---|---|---|---|---|
| X | 0.030 | 0.03 | 1.83 | 0.023 | 0.0035 | 0.035 | 0.0019 | 0.120 | 0.0016 |
| Y | 0.043 | 0.02 | 2.70 | 0.021 | 0.0022 | 0.032 | 0.0022 | 0.140 | 0.0027 |
| Z | 0.038 | 0.70 | 2.10 | 0.008 | 0.0067 | 0.040 | 0.0021 | 0.070 | 0.0009 |
| AA | 0.049 | 0.02 | 0.98 | 0.010 | 0.0050 | 0.026 | 0.0013 | 0.000 | 0.0027 |
| AB | 0.047 | 0.03 | 1.23 | 0.009 | 0.0042 | 0.032 | 0.0019 | 0.100 | 0.0030 |
| AC | 0.030 | 0.02 | 1.92 | 0.013 | 0.0023 | 0.036 | 0.0021 | 0.000 | 0.0000 |
| AD | 0.028 | 0.03 | 1.63 | 0.006 | 0.0033 | 0.042 | 0.0024 | 0.000 | 0.0000 |
| AE | 0.049 | 0.40 | 2.48 | 0.009 | 0.0054 | 0.031 | 0.0019 | 0.500 | 0.0000 |
| AF | 0.035 | 0.02 | 1.20 | 0.012 | 0.0063 | 0.033 | 0.0023 | 0.000 | 0.0000 |

TABLE 13

| Steel No. | Nb | Ti | Ti − 48/14 × N | Mo + Nb + B + Ti | Others | $Ar_3$ (° C.) | Remarks |
|---|---|---|---|---|---|---|---|
| R | 0.000 | 0.009 | 0.002 | 0.0216 | | 692 | Inventive steel |
| S | 0.000 | 0.011 | 0.005 | 0.0478 | | 801 | Inventive steel |
| T | 0.000 | 0.030 | 0.026 | 0.1353 | | 838 | Inventive steel |
| U | 0.000 | 0.025 | 0.017 | 0.5456 | | 775 | Inventive steel |
| V | 0.042 | 0.015 | 0.006 | 0.1391 | | 796 | Inventive steel |
| W | 0.065 | 0.020 | 0.013 | 0.1075 | | 864 | Inventive steel |
| X | 0.030 | 0.012 | 0.005 | 0.1636 | V: 0.02 | 777 | Inventive steel |
| Y | 0.012 | 0.019 | 0.011 | 0.1737 | | 703 | Inventive steel |
| Z | 0.032 | 0.120 | 0.113 | 0.2229 | | 776 | Inventive steel |
| AA | 0.035 | 0.000 | −0.004 | 0.0377 | | 837 | Inventive steel |
| AB | 0.000 | 0.000 | −0.007 | 0.1030 | | 819 | Inventive steel |
| AC | 0.042 | 0.000 | −0.007 | 0.0420 | | 770 | Inventive steel |
| AD | 0.000 | 0.096 | 0.088 | 0.0960 | | 795 | Inventive steel |
| AE | 0.000 | 0.000 | −0.007 | 0.5000 | | 731 | Inventive steel |
| AF | 0.040 | 0.045 | 0.037 | 0.0850 | | 825 | Inventive steel |

TABLE 14

| Sample No. | Steel No. | $Ar_3$ (° C.) | ϵ* | FT (° C.) | CT (° C.) | TS (MPa) | YS (MPa) | El (%) | E (RD) (GPa) | E (D) (GPa) | E (TD) (GPa) |
|---|---|---|---|---|---|---|---|---|---|---|---|
| 79 | A | 756 | 0.52 | 870 | 600 | 408 | 306 | 33 | 233 | 205 | 234 |
| 80 | | | 0.48 | 860 | 500 | 398 | 299 | 35 | 234 | 210 | 233 |
| 81 | | | 0.33 | 890 | 550 | 411 | 303 | 32 | 218 | 210 | 225 |
| 82 | B | 903 | 0.46 | 930 | 600 | 342 | 250 | 41 | 200 | 209 | 212 |
| 83 | | | 0.55 | 872 | 500 | 339 | 244 | 41 | 198 | 195 | 210 |
| 84 | C | 641 | 0.51 | 870 | 500 | 585 | 489 | 20 | 245 | 201 | 242 |
| 85 | | | 0.51 | 780 | 550 | 579 | 472 | 19 | 247 | 196 | 240 |
| 86 | | | 0.55 | 920 | 550 | 575 | 468 | 20 | 202 | 203 | 205 |
| 87 | D | 906 | 0.49 | 830 | 550 | 383 | 295 | 34 | 210 | 212 | 217 |
| 88 | | | 0.31 | 880 | 550 | 394 | 297 | 33 | 208 | 200 | 205 |
| 89 | E | 820 | 0.62 | 850 | 600 | 415 | 319 | 30 | 232 | 193 | 229 |
| 90 | | | 0.58 | 860 | 500 | 432 | 325 | 31 | 232 | 195 | 230 |
| 91 | | | 0.34 | 800 | 550 | 428 | 321 | 32 | 200 | 197 | 208 |
| 92 | F | 995 | 0.56 | 870 | 350 | 615 | 463 | 25 | 205 | 202 | 206 |
| 93 | | | 0.57 | 860 | 350 | 598 | 455 | 25 | 208 | 203 | 203 |
| 94 | G | 701 | 0.45 | 780 | 500 | 781 | 599 | 14 | 245 | 204 | 238 |
| 95 | | | 0.44 | 850 | 500 | 792 | 608 | 14 | 236 | 210 | 236 |
| 96 | | | 0.35 | 810 | 500 | 788 | 600 | 16 | 225 | 212 | 231 |

TABLE 15

| Sample | Texture in the ⅛ sheet thickness layer | | | Texture in the sheet thickness center layer | | | |
|---|---|---|---|---|---|---|---|
| No. | {110}<223> | {110}<111> | {110}<001> | {211}<011> | {332}<113> | {100}<011> | Remarks |
| 79 | 13 | 13 | 1 | 9 | 10 | 4 | I.E. |
| 80 | 12 | 12 | 1 | 11 | 11 | 3 | I.E. |
| 81 | 6 | 7 | 2 | 5 | 4 | 2 | C.E. |
| 82 | 6 | 6 | 7 | 4 | 5 | 4 | C.E. |
| 83 | 7 | 8 | 9 | 6 | 5 | 5 | C.E. |
| 84 | 16 | 17 | 4 | 11 | 13 | 1 | I.E. |
| 85 | 18 | 18 | 2 | 10 | 11 | 1 | I.E. |
| 86 | 8 | 7 | 8 | 8 | 7 | 5 | C.E. |
| 87 | 8 | 8 | 7 | 7 | 5 | 2 | C.E. |

TABLE 15-continued

| Sample No. | Texture in the 1/8 sheet thickness layer {110}<223> | {110}<111> | {110}<001> | Texture in the sheet thickness center layer {211}<011> | {332}<113> | {100}<011> | Remarks |
|---|---|---|---|---|---|---|---|
| 88 | 7 | 6 | 5 | 6 | 5 | 3 | C.E. |
| 89 | 12 | 12 | 1 | 8 | 11 | 1 | I.E. |
| 90 | 11 | 12 | 1 | 10 | 10 | 3 | I.E. |
| 91 | 6 | 6 | 5 | 5 | 5 | 6 | C.E. |
| 92 | 4 | 4 | 5 | 6 | 5 | 5 | C.E. |
| 93 | 4 | 4 | 3 | 6 | 6 | 6 | C.E. |
| 94 | 15 | 14 | 0 | 13 | 11 | 1 | I.E. |
| 95 | 11 | 13 | 1 | 10 | 8 | 1 | I.E. |
| 96 | 8 | 8 | 6 | 11 | 8 | 7 | C.E. |

TABLE 16

| Sample No. | Steel No. | $Ar_3$ (° C.) | ε* | FT (° C.) | CT (° C.) | TS (MPa) | YS (MPa) | El (%) | E (RD) (GPa) | E (D) (GPa) | E (TD) (GPa) |
|---|---|---|---|---|---|---|---|---|---|---|---|
| 97 | H | 922 | 0.45 | 860 | 550 | 635 | 502 | 20 | 195 | 198 | 221 |
| 98 | | | 0.52 | 700 | 550 | 662 | 508 | 18 | 203 | 203 | 215 |
| 99 | I | 876 | 0.56 | 850 | 600 | 720 | 550 | 16 | 212 | 205 | 217 |
| 100 | | | 0.28 | 800 | 600 | 742 | 552 | 15 | 218 | 200 | 221 |
| 101 | J | 840 | 0.43 | 780 | 450 | 715 | 521 | 25 | 210 | 202 | 223 |
| 102 | | | 0.44 | 910 | 450 | 698 | 516 | 24 | 215 | 212 | 218 |
| 103 | K | 688 | 0.56 | 750 | 500 | 890 | 688 | 14 | 247 | 198 | 243 |
| 104 | | | 0.49 | 850 | 550 | 875 | 670 | 15 | 245 | 203 | 240 |
| 105 | | | 0.3 | 880 | 500 | 865 | 670 | 13 | 206 | 203 | 209 |
| 106 | L | 574 | 0.5 | 700 | 550 | 942 | 730 | 12 | 251 | 212 | 240 |
| 107 | | | 0.5 | 850 | 550 | 925 | 712 | 10 | 248 | 210 | 240 |
| 108 | | | 0.29 | 830 | 550 | 899 | 689 | 9 | 220 | 195 | 225 |
| 109 | M | 748 | 0.51 | 820 | 600 | 860 | 660 | 11 | 223 | 211 | 235 |
| 110 | | | 0.37 | 930 | 600 | 851 | 653 | 11 | 210 | 206 | 221 |
| 111 | N | 563 | 0.46 | 780 | 500 | 1121 | 889 | 8 | 253 | 201 | 248 |
| 112 | | | 0.43 | 850 | 500 | 1101 | 895 | 6 | 250 | 207 | 241 |
| 113 | | | 0.38 | 920 | 500 | 1098 | 882 | 5 | 225 | 205 | 223 |

TABLE 17

| Sample No. | Texture in the 1/8 sheet thickness layer {110}<223> | {110}<111> | {110}<001> | Texture in the sheet thickness center layer {211}<011> | {332}<113> | {100}<011> | Remarks |
|---|---|---|---|---|---|---|---|
| 97 | 5 | 5 | 4 | 4 | 4 | 2 | C.E. |
| 98 | 8 | 8 | 10 | 7 | 6 | 8 | C.E. |
| 99 | 7 | 7 | 6 | 9 | 4 | 7 | C.E. |
| 100 | 8 | 8 | 6 | 7 | 5 | 8 | C.E. |
| 101 | 7 | 7 | 5 | 8 | 5 | 8 | C.E. |
| 102 | 6 | 6 | 4 | 5 | 4 | 5 | C.E. |
| 103 | 15 | 16 | 5 | 13 | 11 | 4 | I.E. |
| 104 | 15 | 15 | 3 | 13 | 12 | 5 | I.E. |
| 105 | 5 | 5 | 5 | 5 | 3 | 7 | C.E. |
| 106 | 18 | 19 | 0 | 17 | 15 | 0 | I.E. |
| 107 | 17 | 17 | 0 | 15 | 14 | 0 | I.E. |
| 108 | 9 | 8 | 7 | 7 | 8 | 10 | C.E. |
| 109 | 9 | 9 | 5 | 10 | 7 | 2 | C.E. |
| 110 | 5 | 5 | 3 | 8 | 4 | 9 | C.E. |
| 111 | 21 | 22 | 0 | 15 | 18 | 0 | I.E. |
| 112 | 18 | 18 | 0 | 13 | 15 | 0 | I.E. |
| 113 | 6 | 5 | 2 | 7 | 4 | 6 | C.E. |

TABLE 18

| Sample No. | Steel No. | $Ar_3$ (° C.) | ε* | FT (° C.) | CT (° C.) | TS (MPa) | YS (MPa) | El (%) | E (RD) (GPa) | E (D) (GPa) | E (TD) (GPa) |
|---|---|---|---|---|---|---|---|---|---|---|---|
| 114 | O | 643 | 0.42 | 880 | 650 | 892 | 743 | 10 | 233 | 200 | 239 |
| 115 | P | 742 | 0.45 | 870 | 600 | 598 | 445 | 22 | 238 | 197 | 235 |
| 116 | Q | 852 | 0.5 | 880 | 550 | 785 | 695 | 18 | 245 | 203 | 241 |
| 117 | R | 692 | 0.43 | 830 | 550 | 859 | 773 | 12 | 232 | 205 | 239 |
| 118 | S | 801 | 0.41 | 850 | 500 | 594 | 475 | 25 | 235 | 208 | 235 |

TABLE 18-continued

| Sample No. | Steel No. | $Ar_3$ (° C.) | ε* | FT (° C.) | CT (° C.) | TS (MPa) | YS (MPa) | El (%) | E (RD) (GPa) | E (D) (GPa) | E (TD) (GPa) |
|---|---|---|---|---|---|---|---|---|---|---|---|
| 119 | T | 838 | 0.44 | 880 | 600 | 481 | 385 | 30 | 240 | 199 | 240 |
| 120 | U | 775 | 0.49 | 790 | 500 | 696 | 556 | 23 | 243 | 202 | 239 |
| 121 | V | 796 | 0.56 | 810 | 550 | 719 | 559 | 20 | 241 | 205 | 239 |
| 122 | W | 864 | 0.51 | 890 | 600 | 762 | 553 | 21.04 | 245 | 208 | 241 |
| 123 | X | 777 | 0.42 | 830 | 600 | 592 | 474 | 20 | 239 | 193 | 235 |
| 124 | Y | 703 | 0.43 | 860 | 500 | 721 | 577 | 17 | 247 | 190 | 242 |
| 125 | Z | 776 | 0.49 | 880 | 550 | 779 | 657 | 15 | 243 | 200 | 243 |
| 126 | AA | 837 | 0.44 | 870 | 500 | 463 | 298 | 26 | 239 | 203 | 237 |
| 127 | AB | 819 | 0.42 | 840 | 450 | 502 | 402 | 24 | 237 | 201 | 237 |
| 128 | AC | 770 | 0.44 | 830 | 550 | 604 | 522 | 25 | 233 | 194 | 239 |
| 129 | AD | 795 | 0.52 | 800 | 250 | 562 | 326 | 26 | 237 | 203 | 239 |
| 130 | AE | 731 | 0.48 | 820 | 450 | 745 | 596 | 20 | 239 | 208 | 239 |
| 131 | AF | 825 | 0.5 | 890 | 550 | 652 | 495 | 15 | 241 | 200 | 237 |

TABLE 19

| Sample | Texture in the ⅛ sheet thickness layer | | | Texture in the sheet thickness center layer | | | |
|---|---|---|---|---|---|---|---|
| No. | {110}<223> | {110}<111> | {110}<001> | {211}<011> | {332}<113> | {100}<011> | Remarks |
| 114 | 17 | 17 | 6 | 8 | 8 | 5 | I.E. |
| 115 | 15 | 16 | 5 | 11 | 11 | 4 | I.E. |
| 116 | 15 | 16 | 2 | 10 | 13 | 2 | I.E. |
| 117 | 13 | 14 | 6 | 8 | 10 | 6 | I.E. |
| 118 | 18 | 16 | 4 | 9 | 7 | 3 | I.E. |
| 119 | 12 | 12 | 1 | 12 | 9 | 1 | I.E. |
| 120 | 15 | 15 | 2 | 13 | 11 | 4 | I.E. |
| 121 | 16 | 15 | 1 | 10 | 13 | 2 | I.E. |
| 122 | 13 | 14 | 0 | 10 | 15 | 1 | I.E. |
| 123 | 14 | 13 | 1 | 9 | 11 | 3 | I.E. |
| 124 | 18 | 19 | 1 | 12 | 10 | 1 | I.E. |
| 125 | 17 | 16 | 0 | 9 | 8 | 1 | I.E. |
| 126 | 14 | 15 | 3 | 10 | 11 | 2 | I.E. |
| 127 | 13 | 13 | 3 | 8 | 8 | 4 | I.E. |
| 128 | 16 | 16 | 4 | 11 | 11 | 6 | I.E. |
| 129 | 15 | 14 | 3 | 13 | 13 | 5 | I.E. |
| 130 | 11 | 11 | 3 | 11 | 11 | 4 | I.E. |
| 131 | 13 | 13 | 2 | 15 | 14 | 2 | I.E. |

Example 8

Steel slabs having the composition of steels No. C and L in Tables 10 and 11 were subjected to casting and hot rolling under the conditions shown in Table 20. In all cases, the slabs were heated to a temperature of 1230° C. As for the other rolling conditions, the coefficient of friction between the rollers and the steel sheet in the last three stages of the finishing rolling stand, which was made of a total of seven stages, was in a range of 0.21 to 0.24, and the total of the reduction rates of the last three stages was 55%. In all cases, the skinpass rolling reduction rate was 0.3%. The $Ar_3$ was the same as in Tables 14 and 16.

After rolling, any one of continuous annealing (held at 700° C. for 90 seconds), box annealing (held at 700° C. for 6 hr), and continuous hot-dip galvanization (maximum attained temperature of 750° C.; alloying performed at 500° C. for 20 seconds after immersion in a galvanization bath), was performed, and the tension characteristics and the Young's modulus were measured.

The results are shown in Tables 20 and 21. It should be noted that Table 21 is a continuation of Table 20. It is clear from these results that the Young's modulus is increased by subjecting the steel that has the chemical composition of the present invention to hot rolling under suitable conditions and then appropriate thermal processing.

TABLE 20

| Sample No. | Steel No. | ε* | FT (° C.) | CT (° C.) | Processing after hot rolling | TS (MPa) | YS (MPa) | El (%) | BH (MPa) | E (RD) (GPa) | E (D) (GPa) | E (TD) (GPa) |
|---|---|---|---|---|---|---|---|---|---|---|---|---|
| 132 | C | 0.51 | 870 | 500 | None | 585 | 489 | 20 | 47 | 245 | 201 | 242 |
| 133 | C | 0.51 | 870 | 500 | Continuous annealing | 556 | 442 | 23 | 65 | 243 | 203 | 240 |
| 134 | C | 0.51 | 870 | 500 | Box annealing | 530 | 418 | 25 | 48 | 248 | 201 | 243 |
| 135 | C | 0.51 | 870 | 500 | Continuous alloyed hot-dip galvanization | 549 | 418 | 22 | 62 | 241 | 201 | 240 |
| 136 | L | 0.5 | 850 | 550 | None | 925 | 712 | 10 | 62 | 248 | 210 | 240 |
| 137 | L | 0.5 | 850 | 550 | Continuous annealing | 898 | 716 | 14 | 79 | 245 | 211 | 242 |

TABLE 20-continued

| Sample No. | Steel No. | ϵ* | FT (° C.) | CT (° C.) | Processing after hot rolling | TS (MPa) | YS (MPa) | El (%) | BH (MPa) | E (RD) (GPa) | E (D) (GPa) | E (TD) (GPa) |
|---|---|---|---|---|---|---|---|---|---|---|---|---|
| 138 | L | 0.5 | 850 | 550 | Box annealing | 867 | 694 | 15 | 52 | 251 | 208 | 247 |
| 139 | L | 0.5 | 850 | 550 | Continuous alloyed hot-dip galvanization | 882 | 694 | 12 | 60 | 245 | 208 | 246 |

TABLE 21

| | Texture in the ⅛ sheet thickness layer | | | Texture in the sheet thickness center layer | | | |
|---|---|---|---|---|---|---|---|
| Sample No. | {110}<223> | {110}<111> | {110}<001> | {211}<011> | {332}<113> | {100}<011> | Remarks |
| 132 | 16 | 17 | 0 | 11 | 13 | 1 | I.E. |
| 133 | 17 | 16 | 0 | 11 | 10 | 1 | I.E. |
| 134 | 17 | 18 | 0 | 13 | 12 | 0 | I.E. |
| 135 | 16 | 16 | 0 | 11 | 11 | 0 | I.E. |
| 136 | 17 | 17 | 0 | 15 | 14 | 0 | I.E. |
| 137 | 18 | 17 | 0 | 14 | 13 | 0 | I.E. |
| 138 | 19 | 18 | 0 | 14 | 15 | 0 | I.E. |
| 139 | 17 | 19 | 0 | 15 | 13 | 0 | I.E. |

Example 9

Steel slabs having the composition of steels No. C and L in Tables 10 and 11 were subjected to casting and hot rolling under the conditions shown in Table 22. In all cases, the slabs were heated to a temperature of 1230° C. As for the other rolling conditions, the coefficient of friction between the rollers and the steel sheet in the last three stages of the finishing rolling stand, which was made of a total of seven stages, was in a range of 0.21 to 0.24, and the total of the reduction rates of the last three stages was 55%. In all cases, the skinpass rolling reduction rate was 0.3%. The $Ar_3$ was the same as in Tables 14 and 16.

Cold rolling was conducted after the hot rolling, and then continuous hot-dip galvanization (the maximum attained temperature was variously changed, and alloying was performed at 500° C. for 20 seconds after immersion in a galvanization bath) was performed. The tension characteristics and the Young's modulus were then measured.

The results are shown in Tables 22 and 23. It should be noted that Table 23 is a continuation of Table 22. It is clear from these results that by subjecting the steel that has the chemical composition of the invention to hot rolling and cold rolling, and then subjecting the steel to suitable thermal processing, it is possible to obtain a cold rolled steel sheet that has excellent Young's moduli in both the RD direction and the TD direction. However, in cases where the maximum attained temperature was noticeably high, there was a slight drop in the Young's modulus.

TABLE 22

| Sample No. | Steel No. | ϵ* | FT (° C.) | CT (° C.) | Cold rolling rate (%) | Maximum temperature (° C.) | TS (MPa) | YS (MPa) | El (%) | BH (MPa) | E (RD) (GPa) | E (D) (GPa) | E (TD) (GPa) |
|---|---|---|---|---|---|---|---|---|---|---|---|---|---|
| 140 | C | 0.51 | 870 | 500 | 52 | 970 | 613 | 492 | 17 | 53 | 239 | 211 | 238 |
| 141 | C | 0.51 | 870 | 500 | 52 | 830 | 600 | 478 | 20 | 82 | 244 | 203 | 243 |
| 142 | C | 0.51 | 870 | 500 | 52 | 750 | 589 | 469 | 21 | 65 | 245 | 201 | 203 |
| 143 | L | 0.5 | 850 | 550 | 30 | 970 | 1008 | 789 | 8 | 62 | 239 | 211 | 241 |
| 144 | L | 0.5 | 850 | 550 | 30 | 830 | 976 | 761 | 10 | 78 | 242 | 207 | 238 |
| 145 | L | 0.5 | 850 | 550 | 30 | 750 | 949 | 736 | 11 | 61 | 240 | 203 | 242 |

TABLE 23

| | Texture in the ⅛ sheet thickness layer | | | Texture in the sheet thickness center layer | | | |
|---|---|---|---|---|---|---|---|
| Sample No. | {110}<223> | {110}<111> | {110}<001> | {211}<011> | {332}<113> | {100}<011> | Remarks |
| 140 | 15 | 14 | 0 | 10 | 10 | 2 | I.E. |
| 141 | 17 | 17 | 0 | 11 | 12 | 2 | I.E. |
| 142 | 16 | 17 | 1 | 10 | 11 | 1 | I.E. |
| 143 | 13 | 15 | 1 | 13 | 12 | 2 | I.E. |
| 144 | 16 | 17 | 0 | 15 | 15 | 1 | I.E. |
| 145 | 16 | 15 | 0 | 14 | 15 | 1 | I.E. |

Example 10

Steel slabs having the composition of steels No. C and L in Tables 10 and 11 were subjected to casting and hot rolling under the conditions shown in Table 24. In all cases, the slabs were heated to a temperature of 1230° C. As for the other rolling conditions, the coefficient of friction between the rollers and the steel sheet in the last three stages of the finishing rolling stand, which was made of a total of seven stages, was in a range of 0.21 to 0.24, and the total of the reduction rates of the last three stages was 55%. In all cases, the skinpass rolling reduction rate was 0.3%. The $Ar_3$ was the same as in Tables 14 and 16.

After hot rolling, the steel sheet was heated to 650° C. through a continuous hot-dip galvanization line and then cooled to approximately 470° C., thereafter it was immersed in a 460° C. hot-dip galvanization bath. The thickness of plate of the zinc was 40 g/$m^2$ one side on average. Subsequent to the hot-dip galvanization, the steel sheet surface was subjected to (1) organic film coating or (2) painting as described below, and the tension characteristics and the Young's modulus were measured.

(1) Organic Film 4 mass % corrosion inhibitor and 12% colloidal silica were added to a water-borne resin in which the solid resin portion was 27.6 mass %, the dispersion liquid viscosity was 1400 mPa·s (25° C.), the pH was 8.8, the content of carboxyl group ammonium salts (—$COONH_4$) was 9.5 mass % of the total solid resin portion, the carboxyl group content was 2.5 mass % of the total solid resin portion, and the mean dispersion particle diameter was approximately 0.030 μm, as to produce a rustproofing liquid, and this rustprooting was then applied to the above steel sheet by a roll coater and dried so that the surface of the steel sheet reached a temperature of 120° C., so as to form an approximately 1-μm thick film.

(2) Paint

As a chemical treatment, a roll coater was used to apply "ZM1300AN" made by Nihon Parkerizing Co., Ltd. onto the steel sheet after it had been degreased, and was hot-air dried so that the reached temperature of the steel sheet was 60° C. The amount of deposit of the chemical treatment was 50 mg/$m^2$ of Cr deposit. A primer paint was applied to one side of this chemically treated steel sheet, and a rear surface paint was applied to the other surface, using a roll coater. These were dried and hardened by an induction heater that also employs hot air. The temperature reached at this time was 210° C.

A top paint was then applied by a roller curtain coater to the surface on which the primer paint had been applied, and was dried and hardened by an induction heater that involves the use of hot air at a reached temperature of 230° C. It should be noted that the primer paint was applied at a dry film thickness of 5 μm using "FL640EU Primer" made by Japan Fine Coatings Co., Ltd. The rear surface paint was applied at a dry film thickness of 5 μm using "FL100HQ" made by Japan Fine Coatings Co., Ltd. The top paint was applied at a dry film thickness of 15 μm using "FL100HQ" made by Japan Fine Coatings Co., Ltd.

The results are shown in Tables 24 and 25. It should be noted that Table 25 is a continuation of Table 24. From these results it can be clearly understood that the steel sheets that are subjected to hot-dip galvanization and the steel sheets that are subjected to hot-dip galvanization and have an organic film or paint applied to their surface have a good Young's modulus.

TABLE 24

| Sample No. | Steel No. | ϵ* | FT (° C.) | CT (° C.) | Surface processing | TS (MPa) | YS (MPa) | El (%) | E (RD) (GPa) | E (D) (GPa) | E (TD) (GPa) |
|---|---|---|---|---|---|---|---|---|---|---|---|
| 146 | C | 0.51 | 870 | 500 | Hot-dip galvanization only | 559 | 418 | 22 | 243 | 201 | 242 |
| 147 | C | 0.51 | 870 | 500 | Organic film | 582 | 421 | 22 | 245 | 208 | 243 |
| 148 | C | 0.51 | 870 | 500 | Paint | 590 | 421 | 20 | 247 | 206 | 245 |
| 149 | L | 0.5 | 850 | 550 | Hot-dip galvanization only | 889 | 678 | 10 | 246 | 210 | 240 |
| 150 | L | 0.5 | 850 | 550 | Organic film | 912 | 687 | 9 | 249 | 210 | 243 |
| 151 | L | 0.5 | 850 | 550 | Paint | 932 | 691 | 11 | 251 | 207 | 245 |

TABLE 25

| | Texture in the ⅛ sheet thickness layer | | | Texture in the sheet thickness center layer | | | |
|---|---|---|---|---|---|---|---|
| Sample No. | {110}<223> | {110}<111> | {110}<001> | {211}<011> | {332}<113> | {100}<011> | Remarks |
| 146 | 16 | 17 | 0 | 11 | 13 | 1 | I.E. |
| 147 | 17 | 15 | 0 | 13 | 13 | 1 | I.E. |
| 148 | 19 | 16 | 1 | 12 | 14 | 0 | I.E. |
| 149 | 17 | 17 | 0 | 15 | 14 | 0 | I.E. |
| 150 | 19 | 18 | 0 | 15 | 14 | 1 | I.E. |
| 151 | 19 | 17 | 0 | 16 | 15 | 0 | I.E. |

Example 11

The steels C and L shown in Tables 10 and 11 were subjected to differential speed rolling. The different roll speeds rate was changed over the last three stages of the finishing rolling stand, which was made of a total of seven stages. The hot rolling conditions, and the results of measuring the tension characteristics and the Young's modulus are shown in Table 26. It should be noted that all hot rolling conditions that are not shown in Table 26 are the same as those in Example 7.

The results that were obtained are shown in Tables 26 and 27, It should be noted that Table 27 is a continuation of Table 22. It is clear from the results that the formation of texture near the surface layer is facilitated in the case in which one or more passes of differential speed rolling at 1% or more are added when hot rolling the steel having the chemical composition of the present invention under appropriate conditions, and this further increases the Young's modulus.

TABLE 26

| Sample No. | Steel No. | ϵ* | FT (° C.) | CT (° C.) | Different roll speeds ratio (%) 5th pass | 6th pass | 7th pass | TS (MPa) | YS (MPa) | El (%) | E (RD) (GPa) | E (D) (GPa) | E (TD) (GPa) |
|---|---|---|---|---|---|---|---|---|---|---|---|---|---|
| 152 | C | 0.51 | 870 | 500 | 0 | 0 | 0 | 585 | 489 | 20 | 245 | 201 | 242 |
| 153 | C | 0.49 | 868 | 500 | 0 | 0 | 3 | 591 | 446 | 20 | 247 | 203 | 242 |
| 154 | C | 0.5 | 872 | 500 | 1 | 2 | 3 | 589 | 445 | 20 | 248 | 202 | 240 |
| 155 | C | 0.51 | 875 | 500 | 10 | 5 | 5 | 597 | 451 | 21 | 251 | 202 | 243 |
| 156 | L | 0.5 | 850 | 550 | 0 | 0 | 0 | 925 | 712 | 10 | 248 | 210 | 240 |
| 157 | L | 0.51 | 853 | 550 | 3 | 3 | 3 | 931 | 721 | 11 | 250 | 211 | 242 |
| 158 | L | 0.49 | 855 | 550 | 0 | 0 | 10 | 924 | 715 | 11 | 252 | 211 | 242 |
| 159 | L | 0.5 | 850 | 550 | 0 | 20 | 20 | 925 | 716 | 11 | 254 | 209 | 243 |

TABLE 27

| Sample No. | Texture in the ⅛ sheet thickness layer {110}<223> | {110}<111> | {110}<001> | Texture in the sheet thickness center layer {211}<011> | {332}<113> | {100}<011> | Remarks |
|---|---|---|---|---|---|---|---|
| 152 | 16 | 17 | 0 | 11 | 13 | 1 | I.E. |
| 153 | 17 | 17 | 0 | 10 | 13 | 1 | I.E. |
| 154 | 18 | 16 | 0 | 10 | 14 | 0 | I.E. |
| 155 | 20 | 16 | 1 | 10 | 15 | 0 | I.E. |
| 156 | 17 | 17 | 0 | 15 | 14 | 0 | I.E. |
| 157 | 18 | 17 | 0 | 14 | 14 | 0 | I.E. |
| 158 | 20 | 16 | 1 | 15 | 15 | 0 | I.E. |
| 159 | 22 | 16 | 0 | 13 | 16 | 0 | I.E. |

Example 12

The steel C and L shown in Tables 10 and 11 were subjected to pressure rolling with small-diameter rollers. The roller diameter was changed in the last three stages of the finishing rolling stand, which was made of a total of seven stages. The hot rolling conditions, and the results of measuring the tension characteristics and the Young's modulus are shown in Table 28. It should be noted that all hot rolling conditions that are not shown in Table 28 are the same as those in Example 7.

The results that were obtained are shown in Tables 28 and 29. It should be noted that Table 29 is a continuation of Table 28. It is clear from the results that the formation of texture near the surface is facilitated in the case in which rollers with a roller diameter of 700 mm or less are used in one or more passes when hot rolling the steel having the chemical composition of the present invention under appropriate conditions, and this further increases the Young's modulus.

TABLE 28

| Sample No. | Steel No. | ϵ* | FT (° C.) | CT (° C.) | Roller diameter (mm) 5th pass | 6th pass | 7th pass | TS (MPa) | YS (MPa) | El (%) | E (RD) (GPa) | E (D) (GPa) | E (TD) (GPa) |
|---|---|---|---|---|---|---|---|---|---|---|---|---|---|
| 160 | C | 0.51 | 870 | 500 | 800 | 800 | 800 | 585 | 489 | 20 | 245 | 201 | 242 |
| 161 | C | 0.51 | 873 | 500 | 800 | 800 | 600 | 583 | 440 | 22 | 246 | 202 | 243 |
| 162 | C | 0.53 | 870 | 500 | 600 | 600 | 600 | 585 | 442 | 20 | 249 | 203 | 243 |
| 163 | C | 0.53 | 867 | 500 | 500 | 500 | 500 | 589 | 445 | 19 | 253 | 203 | 243 |
| 164 | L | 0.5 | 850 | 550 | 800 | 800 | 800 | 925 | 712 | 10 | 248 | 210 | 243 |
| 165 | L | 0.51 | 855 | 550 | 800 | 800 | 600 | 927 | 718 | 11 | 251 | 210 | 245 |
| 166 | L | 0.52 | 853 | 550 | 600 | 600 | 600 | 931 | 721 | 11 | 253 | 210 | 246 |
| 167 | L | 0.52 | 852 | 550 | 500 | 500 | 500 | 933 | 723 | 10 | 256 | 212 | 243 |

TABLE 29

| Sample No. | Texture in the ⅛ sheet thickness layer {110}<223> | {110}<111> | {110}<001> | Texture in the sheet thickness center layer {211}<011> | {332}<113> | {100}<011> | Remarks |
|---|---|---|---|---|---|---|---|
| 160 | 16 | 17 | 0 | 11 | 13 | 1 | I.E. |
| 161 | 18 | 16 | 0 | 10 | 14 | 0 | I.E. |
| 162 | 20 | 16 | 1 | 11 | 15 | 2 | I.E. |
| 163 | 22 | 17 | 1 | 11 | 16 | 0 | I.E. |

TABLE 29-continued

| Sample No. | Texture in the ⅛ sheet thickness layer | | | Texture in the sheet thickness center layer | | | Remarks |
|---|---|---|---|---|---|---|---|
| | {110}<223> | {110}<111> | {110}<001> | {211}<011> | {332}<113> | {100}<011> | |
| 164 | 17 | 17 | 0 | 15 | 14 | 0 | I.E. |
| 165 | 18 | 18 | 1 | 14 | 15 | 0 | I.E. |
| 166 | 20 | 17 | 0 | 15 | 15 | 0 | I.E. |
| 167 | 23 | 16 | 0 | 13 | 17 | 0 | I.E. |

Example 13

The steels shown in Tables 30 through 33 were heated from 1200° C. to 1270° C. and hot rolled under the hot rolling conditions shown in Tables 34, 36, 38, and 40, so as to produce hot rolled steel sheets of 2 mm thick. Here, "present" is entered in the column for hot rolled sheet annealing (3*) for those hot rolled steel sheets that have been annealed, and "none" is entered for those hot rolled steel sheets that have not been annealed. This annealing was performed at 600 to 700° C. for 60 minutes. This notation applies in the description for subsequent tables.

As for measuring the Young's modulus of the surface layer, a sample was obtained from the ⅛ sheet thickness layer from the surface layer, and the Young's modulus was measured using the lateral resonance method discussed above. A JIS 5 tension test piece was sampled and the tension characteristics in the transverse direction were evaluated.

The shape fixability was evaluated using a strip-shaped sample 260 mm long×50 mm wide×sheet thickness, molded into a hat-shape with various creasing pressing thicknesses at a punch width of 78 mm, a punch shoulder R of 5 mm, and a die shoulder R of 4 mm, and measuring the shape of the central portion in the sheet width by a three-dimensional shape measuring device. As shown in FIG. 1, the shape fixability was measured by adopting the mean value left and right of the value obtained by subtracting 90' from the angle of the intersection between the line connecting point A and point B and the line connecting point C and point D as the spring back amount, and adopting the value obtained by multiplying the value obtained by left-right averaging the reciprocal of the radius of curvature ρ [mm] between point C and point E by 1000 as the wall camber amount. The smaller 1000/ρ is, the better the shape fixability. It should be noted that bending was performed in such a manner that a fold line appeared perpendicular to the rolling direction.

In general, it is known that when the strength of a steel sheet increases, its shape fixability becomes worse. The inventors actually molded components, and found that in a case where the spring back amount and 1000/ρ at a blank holding force of 70 kN as measured by the method above are (0.015×TS-6) (°) or less, and (0.01×TS-3) ($mm^{-1}$) or less, respective, with respect to the tensile strength [MPa] of the steel sheet, the shape fixability is remarkably good. Thus, the evaluation was conducted taking the fulfilling of these two criteria simultaneously as the condition for good shape fixability.

The results that were obtained are shown in Tables 34 to 41. It should be noted that Table 35 is a continuation of Table 34, and Table 37 is a continuation of Table 36. Also, Table 39 is a continuation of Table 38, and Table 41 is a continuation of Table 40. Here, for the rolling rate (1*), "suitable" is entered if the total rolling rate of the hot rolling is 50% or more, and "unsuitable" is entered if this is less than 50%. For the coefficient of friction (2*), "suitable" is entered if the mean coefficient of friction during hot rolling is greater than 0.2, and "unsuitable" is entered if this is 0.2 or less. The shape fixability is listed as "good" if the two criteria are met, and "poor" if they are not met. These entries are the same in the subsequent descriptions of the tables.

When the blank holding force is increased, 1000/ρ tends to become smaller. However, regardless of the blank holding force that is chosen, the dominance order of the shape fixability of the steel sheet does not change, Consequently, the evaluation at 70 kN of blank holding force accurately represents the shape fixability of the steel sheet.

TABLE 30

| Steel No. | C | Si | Mn | P | S | Al | N | Mo | B |
|---|---|---|---|---|---|---|---|---|---|
| P1 | 0.003 | 0.01 | 1.50 | 0.080 | 0.0012 | 0.036 | 0.0025 | 0.200 | 0.0010 |
| P2 | 0.031 | 0.75 | 0.50 | 0.013 | 0.0009 | 0.029 | 0.0027 | 0.420 | 0.0020 |
| P3 | 0.023 | 0.02 | 0.60 | 0.009 | 0.0034 | 0.029 | 0.0025 | 0.350 | 0.0020 |
| P4 | 0.042 | 0.36 | 0.32 | 0.008 | 0.0026 | 0.031 | 0.0036 | 0.430 | 0.0020 |
| P5 | 0.020 | 0.09 | 1.45 | 0.015 | 0.0006 | 0.032 | 0.0024 | 0.180 | 0.0010 |
| P6 | 0.045 | 0.53 | 1.85 | 0.010 | 0.0045 | 0.037 | 0.0041 | 0.170 | 0.0009 |
| P7 | 0.080 | 1.30 | 1.70 | 0.028 | 0.0062 | 0.034 | 0.0031 | 0.210 | 0.0013 |
| P8 | 0.160 | 0.07 | 0.98 | 0.013 | 0.0053 | 0.044 | 0.0024 | 0.300 | 0.0015 |
| P9 | 0.110 | 0.05 | 2.12 | 0.010 | 0.0036 | 0.680 | 0.0024 | 0.290 | 0.0020 |
| P10 | 0.150 | 1.80 | 1.95 | 0.018 | 0.0028 | 0.019 | 0.0031 | 0.320 | 0.0022 |
| P11 | 0.007 | 0.08 | 1.22 | 0.030 | 0.0035 | 0.023 | 0.0021 | 0.070 | 0.0030 |
| P12 | 0.130 | 0.11 | 1.52 | 0.009 | 0.0065 | 0.034 | 0.0022 | 0.000 | 0.0000 |
| P13 | 0.020 | 0.06 | 0.98 | 0.012 | 0.0033 | 0.070 | 0.0033 | 0.000 | 0.0025 |
| P14 | 0.079 | 0.06 | 0.73 | 0.013 | 0.0045 | 0.032 | 0.0028 | 0.300 | 0.0000 |
| P15 | 0.060 | 0.20 | 0.77 | 0.040 | 0.0052 | 0.029 | 0.0022 | 0.140 | 0.0028 |

TABLE 31

| Steel No. | Nb | Ti | Ti − 48/14 × N | Mo + Nb + Ti + B | Others | $Ar_3$ (° C.) | Remarks |
|---|---|---|---|---|---|---|---|
| P1 | 0.030 | 0.018 | 0.0094 | 0.249 | | 781 | Inventive steel |
| P2 | 0.028 | 0.018 | 0.0087 | 0.468 | | 842 | Inventive steel |
| P3 | 0.018 | 0.020 | 0.0114 | 0.390 | | 818 | Inventive steel |
| P4 | 0.03 | 0.031 | 0.0187 | 0.493 | | 840 | Inventive steel |
| P5 | 0.042 | 0.010 | 0.0018 | 0.233 | | 783 | Inventive steel |
| P6 | 0.022 | 0.023 | 0.0089 | 0.216 | Cr: 0.5 | 761 | Inventive steel |
| P7 | 0.021 | 0.013 | 0.0024 | 0.245 | | 778 | Inventive steel |
| P8 | 0.033 | 0.021 | 0.0128 | 0.356 | Ca: 0.0015 | 762 | Inventive steel |
| P9 | 0.035 | 0.012 | 0.0038 | 0.339 | V: 0.02 | 806 | Inventive steel |
| P10 | 0.035 | 0.015 | 0.0044 | 0.372 | | 727 | Inventive steel |
| P11 | 0.022 | 0.021 | 0.0138 | 0.116 | | 782 | Inventive steel |
| P12 | 0.080 | 0.000 | −0.0075 | 0.080 | | 774 | Inventive steel |
| P13 | 0.052 | 0.000 | −0.0113 | 0.055 | | 819 | Inventive steel |
| P14 | 0.000 | 0.000 | −0.0096 | 0.300 | | 826 | Inventive steel |
| P15 | 0.000 | 0.000 | −0.0075 | 0.143 | | 804 | Inventive steel |

TABLE 32

| Steel No. | C | Si | Mn | P | S | Al | N | Mo | B |
|---|---|---|---|---|---|---|---|---|---|
| P16 | 0.062 | 0.23 | 1.20 | 0.006 | 0.0066 | 0.042 | 0.0025 | 0.000 | 0.0000 |
| P17 | 0.062 | 0.06 | 2.35 | 0.012 | 0.0003 | 0.033 | 0.0026 | 0.000 | 0.0000 |
| P18 | 0.067 | 0.24 | 1.52 | 0.008 | 0.0045 | 0.035 | 0.0023 | 0.080 | 0.0011 |
| P19 | 0.043 | 0.53 | 1.98 | 0.010 | 0.0036 | 0.042 | 0.0022 | 0.130 | 0.0020 |
| C1 | 0.020 | 0.01 | 1.50 | 0.012 | 0.0017 | 0.032 | 0.0035 | 0.000 | 0.0001 |
| C2 | 0.010 | 0.37 | 1.20 | 0.010 | 0.0003 | 0.023 | 0.0033 | 0.005 | 0.0023 |
| C3 | 0.051 | 0.57 | 0.05 | 0.009 | 0.0026 | 0.026 | 0.0029 | 0.230 | 0.0001 |
| C4 | 0.045 | 2.60 | 1.80 | 0.014 | 0.0042 | 0.027 | 0.0024 | 0.000 | 0.0010 |
| C5 | 0.100 | 1.30 | 1.70 | 0.062 | 0.0056 | 1.200 | 0.0030 | 0.600 | 0.0008 |
| C6 | 0.120 | 1.80 | 0.10 | 0.007 | 0.0029 | 0.620 | 0.0032 | 0.330 | 0.0004 |

TABLE 33

| Steel No. | Nb | Ti | Ti − 48/14 × N | Mo + Nb + Ti + B | Others | $Ar_3$ (° C.) | Remarks |
|---|---|---|---|---|---|---|---|
| P16 | 0.040 | 0.080 | 0.0714 | 0.120 | W: 0.01 | 826 | Inventive steel |
| P17 | 0.000 | 0.110 | 0.1011 | 0.110 | | 726 | Inventive steel |
| P18 | 0.024 | 0.015 | 0.0071 | 0.120 | | 775 | Inventive steel |
| P19 | 0.033 | 0.020 | 0.0125 | 0.185 | | 739 | Inventive steel |
| C1 | 0.001 | 0.009 | −0.0030 | 0.010 | | 804 | Comparative steel |
| C2 | 0.002 | 0.000 | −0.0113 | 0.009 | | 808 | Comparative steel |
| C3 | 0.040 | 0.023 | 0.0131 | 0.293 | | 909 | Comparative steel |
| C4 | 0.000 | 0.005 | −0.0032 | 0.006 | Cu: 0.2 | 843 | Comparative steel |
| C5 | 0.024 | 0.021 | 0.0107 | 0.646 | | 981 | Comparative steel |
| C6 | 0.031 | 0.007 | −0.0040 | 0.368 | | 1031 | Comparative steel |

TABLE 34

| Sample No. | Steel No. | $Ar_3$ (° C.) | ϵ* | Rolling rate (1*) | Coefficient of friction (2*) | FT (° C.) | CT (° C.) | Hot rolled sheet annealing (3*) | TS (MPa) | E(RD) (GPa) | E(D) (GPa) | E(TD) (GPa) | Surface layer Young's modulus in rolling direction (GPa) | Surface layer Young's modulus in transverse direction (GPa) |
|---|---|---|---|---|---|---|---|---|---|---|---|---|---|---|
| 168 | P1 | 781 | 0.65 | Suitable | Suitable | 835 | 500 | None | 469 | 246 | 205 | 240 | 255 | 255 |
| 169 | | | 0.57 | Suitable | Suitable | 830 | 600 | None | 460 | 243 | 206 | 239 | 253 | 256 |
| 170 | | | 0.37 | Suitable | Suitable | 850 | 550 | None | 467 | 212 | 205 | 235 | 221 | 239 |
| 171 | P2 | 842 | 0.72 | Suitable | Suitable | 860 | 400 | None | 500 | 245 | 199 | 239 | 259 | 263 |
| 172 | | | 0.59 | Suitable | Suitable | 875 | 600 | None | 498 | 250 | 200 | 245 | 262 | 257 |
| 173 | | | 0.49 | Unsuitable | Suitable | 880 | 600 | None | 503 | 204 | 205 | 218 | 218 | 229 |
| 174 | P3 | 818 | 0.67 | Suitable | Suitable | 840 | 450 | None | 446 | 242 | 203 | 238 | 253 | 255 |
| 175 | | | 0.82 | Suitable | Suitable | 870 | 450 | Present | 450 | 241 | 202 | 240 | 254 | 254 |
| 176 | | | 0.48 | Suitable | Unsuitable | 850 | 450 | None | 449 | 213 | 206 | 239 | 225 | 235 |
| 177 | P4 | 840 | 0.52 | Suitable | Suitable | 860 | 500 | Present | 479 | 246 | 198 | 40 | 256 | 261 |
| 178 | | | 0.59 | Suitable | Suitable | 875 | 500 | None | 482 | 239 | 197 | 238 | 248 | 253 |
| 179 | | | 0.57 | Suitable | Suitable | 750 | 500 | None | 485 | 214 | 200 | 230 | 223 | 223 |

TABLE 35

| Sample No. | Texture in the 1/8 sheet thickness layer {110} <223> | {110} <111> | {110} <001> | Texture in the sheet thickness center layer {211} <011> | {332} <113> | {100} <011> | Spring back (°) | Wall camber (1000/ρ) | Shape fixability | Remarks |
|---|---|---|---|---|---|---|---|---|---|---|
| 168 | 13 | 13 | 3 | 10 | 10 | 2 | 0.0 | 0.4 | Good | I.E. |
| 169 | 13 | 12 | 2 | 9 | 9 | 1 | 0.5 | 0.4 | Good | I.E. |
| 170 | 4 | 5 | 6 | 5 | 3 | 5 | 1.4 | 2.2 | Poor | C.E. |
| 171 | 13 | 12 | 3 | 11 | 10 | 2 | 0.1 | 0.7 | Good | I.E. |
| 172 | 16 | 15 | 3 | 10 | 12 | 3 | 0.3 | 0.8 | Good | I.E. |
| 173 | 5 | 4 | 3 | 4 | 3 | 4 | 2.2 | 3.2 | Poor | C.E. |
| 174 | 12 | 12 | 0 | 9 | 10 | 3 | 0.1 | 0.9 | Good | I.E. |
| 175 | 13 | 13 | 0 | 8 | 9 | 2 | 0.0 | 0.9 | Good | I.E. |
| 176 | 5 | 6 | 4 | 5 | 3 | 5 | 1.4 | 1.9 | Poor | C.E. |
| 177 | 14 | 15 | 1 | 10 | 10 | 2 | 0.0 | 0.8 | Good | I.E. |
| 178 | 12 | 11 | 2 | 9 | 8 | 4 | 0.1 | 1.5 | Good | I.E. |
| 179 | 6 | 5 | 6 | 5 | 3 | 5 | 1.3 | 2.8 | Poor | C.E. |

TABLE 36

| Sample No. | Steel No. | $Ar_3$ (° C.) | ε* | Rolling rate (1*) | Coefficient of friction (2*) | FT (° C.) | CT (° C.) | Hot rolled sheet annealing (3*) | TS (MPa) | E(RD) (GPa) | E(D) (GPa) | E(TD) (GPa) | Surface layer Young's modulus in rolling direction (GPa) | Surface layer Young's modulus in transverse direction (GPa) |
|---|---|---|---|---|---|---|---|---|---|---|---|---|---|---|
| 180 | P5 | 783 | 0.64 | Suitable | Suitable | 820 | 600 | None | 590 | 239 | 206 | 237 | 245 | 241 |
| 181 | | | 0.63 | Suitable | Suitable | 880 | 600 | None | 553 | 248 | 203 | 245 | 259 | 255 |
| 182 | | | 0.72 | Suitable | Suitable | 920 | 600 | None | 567 | 209 | 200 | 218 | 231 | 253 |
| 183 | P6 | 788 | 0.65 | Suitable | Suitable | 880 | 350 | None | 632 | 248 | 197 | 243 | 268 | 257 |
| 184 | | | 0.52 | Suitable | Suitable | 870 | 500 | None | 609 | 246 | 195 | 239 | 262 | 263 |
| 185 | | | 0.57 | Suitable | Suitable | 860 | 730 | None | 578 | 216 | 201 | 229 | 225 | 229 |
| 186 | P7 | 778 | 0.61 | Suitable | Suitable | 830 | 450 | None | 782 | 246 | 203 | 238 | 255 | 255 |
| 187 | | | 0.76 | Suitable | Suitable | 850 | 250 | None | 779 | 247 | 195 | 244 | 262 | 255 |
| 188 | | | 0.72 | Suitable | Suitable | 930 | 400 | None | 749 | 203 | 199 | 213 | 209 | 219 |
| 189 | P8 | 762 | 0.59 | Suitable | Suitable | 830 | 350 | None | 792 | 235 | 200 | 239 | 249 | 238 |
| 190 | | | 0.54 | Suitable | Suitable | 850 | 500 | Present | 800 | 240 | 205 | 238 | 253 | 255 |
| 191 | | | 0.25 | Suitable | Unsuitable | 850 | 400 | None | 803 | 210 | 203 | 220 | 219 | 220 |

TABLE 37

| Sample No. | Texture in the 1/8 sheet thickness layer {110} <223> | {110} <111> | {110} <001> | Texture in the sheet thickness center layer {211} <011> | {332} <113> | {100} <011> | Spring back (°) | Wall camber (1000/ρ) | Shape fixability | Remarks |
|---|---|---|---|---|---|---|---|---|---|---|
| 180 | 11 | 10 | 1 | 9 | 8 | 1 | 1.0 | 2.1 | Good | I.E. |
| 181 | 14 | 13 | 3 | 11 | 11 | 0 | 0.6 | 1.5 | Good | I.E. |
| 182 | 4 | 5 | 5 | 4 | 3 | 6 | 3.0 | 3.0 | Poor | C.E. |
| 183 | 14 | 13 | 0 | 10 | 11 | 2 | 0.6 | 1.9 | Good | I.E. |
| 184 | 14 | 14 | 1 | 11 | 10 | 4 | 1.0 | 1.4 | Good | I.E. |
| 185 | 6 | 5 | 6 | 5 | 4 | 6 | 3.4 | 3.0 | Poor | C.E. |
| 186 | 14 | 15 | 0 | 10 | 10 | 2 | 4.6 | 4.0 | Good | I.E. |
| 187 | 13 | 14 | 2 | 12 | 11 | 3 | 4.0 | 3.5 | Good | I.E. |
| 188 | 5 | 4 | 2 | 5 | 3 | 7 | 6.5 | 5.8 | Poor | C.E. |
| 189 | 10 | 11 | 1 | 8 | 9 | 2 | 5.1 | 4.1 | Good | I.E. |
| 190 | 11 | 12 | 0 | 7 | 8 | 4 | 4.4 | 3.6 | Good | I.E. |
| 191 | 5 | 5 | 5 | 4 | 4 | 6 | 6.8 | 5.7 | Poor | C.E. |

TABLE 38

| Sample No. | Steel No. | $Ar_3$ (° C.) | ε* | Rolling rate (1*) | Coefficient of friction (2*) | FT (° C.) | CT (° C.) | Hot rolled sheet annealing (3*) | TS (MPa) | E(RD) (GPa) | E(D) (GPa) | E(TD) (GPa) | Surface layer Young's modulus in rolling direction (GPa) | Surface layer Young's modulus in transverse direction (GPa) |
|---|---|---|---|---|---|---|---|---|---|---|---|---|---|---|
| 192 | P9 | 806 | 0.67 | Suitable | Suitable | 860 | 500 | None | 980 | 241 | 198 | 236 | 252 | 259 |
| 193 | | | 0.72 | Suitable | Suitable | 870 | 400 | None | 997 | 239 | 209 | 235 | 250 | 253 |
| 194 | | | 0.71 | Unsuitable | Suitable | 850 | 350 | None | 1029 | 213 | 210 | 219 | 225 | 245 |
| 195 | P10 | 727 | 0.47 | Suitable | Suitable | 780 | 300 | None | 1008 | 245 | 211 | 237 | 256 | 260 |
| 196 | | | 0.5 | Suitable | Suitable | 830 | 350 | None | 1102 | 247 | 208 | 237 | 261 | 255 |
| 197 | | | 0.52 | Suitable | Unsuitable | 850 | 500 | None | 904 | 206 | 203 | 230 | 215 | 219 |
| 198 | P11 | 782 | 0.41 | Suitable | Suitable | 840 | 500 | None | 498 | 241 | 211 | 236 | 250 | 249 |
| 199 | P12 | 774 | 0.44 | Suitable | Suitable | 860 | 550 | None | 605.8 | 240 | 206 | 236 | 253 | 243 |
| 200 | P13 | 819 | 0.62 | Suitable | Suitable | 830 | 500 | None | 652 | 239 | 209 | 239 | 249 | 246 |
| 201 | P14 | 826 | 0.42 | Suitable | Suitable | 860 | 600 | None | 723 | 242 | 196 | 238 | 256 | 247 |
| 202 | P15 | 804 | 0.53 | Suitable | Suitable | 850 | 500 | None | 525.7 | 239 | 200 | 236 | 262 | 249 |
| 203 | P16 | 826 | 0.56 | Suitable | Suitable | 880 | 550 | None | 581.5 | 237 | 202 | 238 | 246 | 242 |
| 204 | P17 | 726 | 0.59 | Suitable | Suitable | 800 | 450 | None | 700.5 | 245 | 200 | 237 | 253 | 253 |

TABLE 39

| | Texture in the ⅛ sheet thickness layer | | | Texture in the sheet thickness center layer | | | Spring | Wall | | |
|---|---|---|---|---|---|---|---|---|---|---|
| Sample No. | {110} <223> | {110} <111> | {110} <001> | {211} <011> | {332} <113> | {100} <011> | back (°) | camber (1000/ρ) | Shape fixability | Remarks |
| 192 | 12 | 12 | 3 | 9 | 9 | 3 | 7.9 | 5.8 | Good | I.E. |
| 193 | 11 | 10 | 1 | 10 | 8 | 1 | 8.0 | 6.4 | Good | I.E. |
| 194 | 5 | 5 | 4 | 4 | 3 | 5 | 10.0 | 7.9 | Poor | C.E. |
| 195 | 13 | 12 | 2 | 10 | 10 | 2 | 7.8 | 6.2 | Good | I.E. |
| 196 | 14 | 13 | 0 | 11 | 11 | 3 | 8.7 | 6.8 | Good | I.E. |
| 197 | 4 | 4 | 3 | 5 | 3 | 5 | 9.2 | 6.7 | Poor | C.E. |
| 198 | 12 | 12 | 6 | 10 | 9 | 5 | 0.5 | 0.0 | Good | I.E. |
| 199 | 13 | 12 | 4 | 9 | 8 | 4 | 1.9 | 2.0 | Good | I.E. |
| 200 | 11 | 12 | 3 | 9 | 8 | 3 | 2.5 | 3.0 | Good | I.E. |
| 201 | 11 | 12 | 2 | 8 | 9 | 2 | 3.2 | 3.0 | Good | I.E. |
| 202 | 11 | 10 | 0 | 10 | 8 | 4 | 0.9 | 1.2 | Good | I.E. |
| 203 | 15 | 14 | 6 | 9 | 8 | 4 | 1.2 | 1.8 | Good | I.E. |
| 204 | 14 | 14 | 5 | 9 | 10 | 1 | 3.1 | 3.0 | Good | I.E. |

TABLE 40

| Sample No. | Steel No. | $Ar_3$ (° C.) | ε* | Rolling rate (1*) | Coefficient of friction (2*) | FT (° C.) | CT (° C.) | Hot rolled sheet annealing (3*) | TS (MPa) | E(RD) (GPa) | E(D) (GPa) | E(TD) (GPa) | Surface layer Young's modulus in rolling direction (GPa) | Surface layer Young's modulus in transverse direction (GPa) |
|---|---|---|---|---|---|---|---|---|---|---|---|---|---|---|
| 205 | P18 | 775 | 0.44 | Suitable | Suitable | 880 | 400 | None | 621.6 | 249 | 199 | 239 | 260 | 255 |
| 206 | P19 | 739 | 0.48 | Suitable | Suitable | 860 | 500 | None | 712.7 | 243 | 200 | 235 | 256 | 250 |
| 207 | C1 | 804 | 0.65 | Suitable | Suitable | 880 | 400 | Present | 439 | 204 | 205 | 205 | 210 | 225 |
| 208 | | | 0.68 | Unsuitable | Suitable | 850 | 450 | None | 419 | 196 | 203 | 209 | 205 | 226 |
| 209 | C2 | 808 | 0.78 | Suitable | Suitable | 840 | 500 | Present | 439 | 201 | 207 | 205 | 223 | 249 |
| 210 | | | 0.88 | Suitable | Suitable | 850 | 750 | None | 447 | 200 | 205 | 203 | 209 | 231 |
| 211 | C3 | 909 | 0.57 | Suitable | Suitable | 820 | 600 | None | 567 | 208 | 207 | 219 | 227 | 246 |
| 212 | | | 0.67 | Suitable | Suitable | 840 | 500 | None | 557 | 212 | 205 | 220 | 225 | 245 |
| 213 | C4 | 843 | 0.95 | Suitable | Suitable | 850 | 550 | None | 529 | 199 | 206 | 218 | 208 | 222 |
| 214 | | | 0.77 | Suitable | Suitable | 880 | 550 | Present | 549 | 200 | 206 | 223 | 203 | 220 |
| 215 | C5 | 981 | 0.65 | Suitable | Suitable | 870 | 450 | None | 780 | 205 | 199 | 209 | 198 | 221 |
| 216 | | | 0.32 | Suitable | Suitable | 830 | 300 | None | 770 | 195 | 200 | 230 | 204 | 219 |
| 217 | C6 | 1031 | 0.44 | Suitable | Suitable | 850 | 300 | None | 790 | 222 | 205 | 207 | 231 | 237 |
| 218 | | | 0.7 | Unsuitable | Suitable | 800 | 250 | None | 834 | 196 | 203 | 220 | 205 | 223 |

TABLE 41

| Sample No. | Texture in the 1/8 sheet thickness layer {110} <223> | {110} <111> | {110} <001> | Texture in the sheet thickness center layer {211} <011> | {332} <113> | {100} <011> | Spring back (°) | Wall camber (1000/ρ) | Shape fixability | Remarks |
|---|---|---|---|---|---|---|---|---|---|---|
| 205 | 15 | 14 | 2 | 12 | 11 | 2 | 2.0 | 2.2 | Good | I.E. |
| 206 | 12 | 13 | 4 | 10 | 9 | 3 | 3.4 | 3.1 | Good | I.E. |
| 207 | 4 | 5 | 3 | 5 | 4 | 3 | 1.5 | 2.8 | Poor | C.E. |
| 208 | 8 | 9 | 7 | 4 | 3 | 6 | 2.0 | 2.8 | Poor | C.E. |
| 209 | 4 | 3 | 4 | 4 | 5 | 5 | 1.2 | 1.7 | Poor | C.E. |
| 210 | 4 | 5 | 3 | 5 | 3 | 6 | 2.5 | 3.2 | Poor | C.E. |
| 211 | 6 | 7 | 5 | 3 | 5 | 4 | 2.9 | 3.2 | Poor | C.E. |
| 212 | 5 | 4 | 4 | 5 | 2 | 3 | 2.9 | 3.0 | Poor | C.E. |
| 213 | 5 | 6 | 4 | 6 | 3 | 5 | 3.4 | 3.5 | Poor | C.E. |
| 214 | 7 | 8 | 5 | 4 | 5 | 4 | 4.0 | 4.3 | Poor | C.E. |
| 215 | 7 | 6 | 6 | 5 | 3 | 5 | 7.9 | 6.4 | Poor | C.E. |
| 216 | 5 | 4 | 3 | 5 | 3 | 7 | 7.7 | 6.5 | Poor | C.E. |
| 217 | 8 | 7 | 7 | 6 | 4 | 5 | 5.8 | 5.2 | Poor | C.E. |
| 218 | 5 | 6 | 5 | 3 | 6 | 5 | 8.4 | 6.5 | Poor | C.E. |

Example 14

The steels P5 and P8 shown in Tables 30 and 31 were subjected to differential speed rolling. The different roll speeds rate was changed in the last three stages of the finishing rolling stand, which was constituted by a total of seven stages. The hot rolling conditions, the results of measuring the tension characteristics and the Young's modulus, and the results of evaluating the shape fixability, are shown in Table 42. It should be noted that manufacturing conditions that are not listed in the table are the same as those in Example 13.

The results that were obtained are shown in Tables 42 and 43. It should be noted that Table 43 is a continuation of Table 42. It is clear from the results that in the case in which one or more passes of differential speed rolling at 1% or more are added when hot rolling the steel that has the chemical composition of the present invention under appropriate conditions, the Young's modulus near the surface layer is increased even further and the shape fixability is good

TABLE 42

| Sample No. | Steel No. | $Ar_3$ (° C.) | ε* | Rolling rate (1*) | Coefficient of friction (2*) | FT (° C.) | CT (° C.) | Different roll speeds ratio (%) 5th pass | 6th pass | 7th pass | Hot rolled sheet annealing (3*) | TS (MPa) | E (RD) (GPa) | E (D) (GPa) | E (TD) (GPa) | Surface layer Young's modulus in rolling direction (GPa) | Surface layer Young's modulus in transverse direction (GPa) |
|---|---|---|---|---|---|---|---|---|---|---|---|---|---|---|---|---|---|
| 219 | P5 | 783 | 0.65 | Suitable | Suitable | 870 | 500 | 0 | 0 | 0 | None | 582 | 239 | 205 | 236 | 245 | 247 |
| 220 | | | 0.67 | Suitable | Suitable | 880 | 500 | 0 | 0 | 3 | Present | 590 | 242 | 205 | 238 | 259 | 250 |
| 221 | | | 0.67 | Suitable | Suitable | 860 | 500 | 1 | 2 | 3 | None | 598 | 244 | 202 | 240 | 252 | 252 |
| 222 | | | 0.66 | Suitable | Suitable | 870 | 500 | 10 | 5 | 5 | None | 584 | 248 | 200 | 242 | 266 | 259 |
| 223 | P8 | 762 | 0.65 | Suitable | Suitable | 850 | 500 | 0 | 0 | 0 | None | 793 | 240 | 195 | 235 | 249 | 248 |
| 224 | | | 0.65 | Suitable | Suitable | 860 | 500 | 3 | 3 | 3 | Present | 775 | 241 | 198 | 237 | 257 | 249 |
| 225 | | | 0.67 | Suitable | Suitable | 850 | 500 | 0 | 0 | 10 | None | 780 | 243 | 196 | 238 | 255 | 250 |
| 226 | | | 0.65 | Suitable | Suitable | 850 | 500 | 0 | 20 | 20 | None | 789 | 246 | 197 | 240 | 263 | 252 |

TABLE 43

| Sample No. | Texture in the 1/8 sheet thickness layer {110} <223> | {110} <111> | {110} <001> | Texture in the sheet thickness center layer {211} <011> | {332} <113> | {100} <011> | Spring back (°) | Wall camber (1000/ρ) | Shape fixability | Remarks |
|---|---|---|---|---|---|---|---|---|---|---|
| 219 | 13 | 12 | 2 | 9 | 8 | 4 | 1.7 | 2.1 | Good | I.E. |
| 220 | 12 | 11 | 1 | 9 | 9 | 3 | 1.1 | 1.8 | Good | I.E. |
| 221 | 12 | 13 | 0 | 10 | 10 | 3 | 0.6 | 1.6 | Good | I.E. |
| 222 | 14 | 15 | 0 | 11 | 12 | 1 | 0.1 | 1.3 | Good | I.E. |
| 223 | 11 | 12 | 2 | 10 | 9 | 3 | 5.2 | 4.1 | Good | I.E. |
| 224 | 12 | 11 | 0 | 9 | 8 | 2 | 4.7 | 3.6 | Good | I.E. |
| 225 | 12 | 13 | 0 | 11 | 9 | 2 | 4.2 | 3.3 | Good | I.E. |
| 226 | 15 | 14 | 0 | 10 | 10 | 1 | 3.9 | 3 | Good | I.E. |

Example 15

The steels P5 and P8 shown in Tables 30 and 31 were subjected to pressure rolling with small-diameter rollers. The roller diameter was changed in the last three stages of the finishing rolling stand, which was constituted by a total of six stages. The hot rolling conditions, the results of measuring the tension characteristics and the Young's modulus, and the results of evaluating the shape fixability, are shown in Table 44. It should be noted that manufacturing conditions that are not listed in the table are the same as those in Example 13.

The results that were obtained are shown in Tables 44 and 45. It should be noted that Table 45 is a continuation of Table 44. It is clear from the results that in the case in which rollers with a roller diameter of 700 nm or less are used in one or more passes when hot rolling the steel that has the chemical composition of the present invention under appropriate conditions, the Young's modulus near the surface layer is increased even further and the shape fixability is good.

Example 16

A cold-rolled, annealed sheets were manufactured using the steels P5 and P8 shown in Tables 30 and 31. The hot rolling, cold rolling, and annealing conditions, the tension characteristics, the results of measuring the Young's modulus, and the results of evaluating the shape fixability, are shown in Table 46. It should be noted that the manufacturing conditions that are not listed in the table are the same as those in Example 13.

The results that were obtained are shown in Tables 46 and 47. It should be noted that Table 47 is a continuation of Table 46. It is clear from the results that in the case in which the steel having the chemical composition of the present invention is hot rolled, cold rolled, and annealed under appropriate conditions, the Young's modulus of the surface layer exceeds 245 GPa and the shape fixability is increased,

TABLE 44

| Sample No. | Steel No. | $Ar_3$ (° C.) | ε* | Rolling rate (1*) | Coefficient of friction (2*) | FT (° C.) | CT (° C.) | Roller diameter (mm) 4th pass | 5th pass | 6th pass | Hot rolled sheet annealing (3*) | TS (MPa) | E (RD) (GPa) | E (D) (GPa) | E (TD) (GPa) | Surface layer Young's modulus in rolling direction (GPa) | Surface layer Young's modulus in transverse direction (GPa) |
|---|---|---|---|---|---|---|---|---|---|---|---|---|---|---|---|---|---|
| 227 | P5 | 783 | 0.62 | Suitable | Suitable | 850 | 550 | 800 | 800 | 800 | None | 579 | 238 | 205 | 239 | 246 | 249 |
| 228 | | | 0.67 | Suitable | Suitable | 855 | 550 | 800 | 800 | 600 | None | 577 | 241 | 202 | 240 | 247 | 251 |
| 229 | | | 0.6 | Suitable | Suitable | 860 | 550 | 600 | 600 | 600 | None | 592 | 245 | 205 | 240 | 253 | 253 |
| 230 | | | 0.73 | Suitable | Suitable | 845 | 550 | 500 | 500 | 500 | None | 585 | 249 | 198 | 246 | 257 | 256 |
| 231 | P8 | 762 | 0.65 | Suitable | Suitable | 870 | 550 | 800 | 800 | 800 | None | 792 | 241 | 199 | 237 | 249 | 250 |
| 232 | | | 0.63 | Suitable | Suitable | 860 | 550 | 800 | 800 | 600 | Present | 783 | 245 | 200 | 239 | 255 | 249 |
| 233 | | | 0.67 | Suitable | Suitable | 860 | 550 | 600 | 600 | 600 | None | 801 | 247 | 198 | 240 | 260 | 251 |
| 234 | | | 0.6 | Suitable | Suitable | 865 | 550 | 500 | 500 | 500 | None | 803 | 251 | 202 | 241 | 265 | 260 |

TABLE 45

| Sample No. | Texture in the ⅛ sheet thickness layer {110} <223> | {110} <111> | {110} <001> | Texture in the sheet thickness center layer {211} <011> | {332} <113> | {100} <011> | Spring back (°) | Wall camber (1000/ρ) | Shape fixability | Remarks |
|---|---|---|---|---|---|---|---|---|---|---|
| 227 | 11 | 11 | 2 | 9 | 7 | 3 | 1.9 | 2.1 | Good | I.E. |
| 228 | 12 | 12 | 1 | 9 | 8 | 0 | 1.2 | 1.8 | Good | I.E. |
| 229 | 13 | 12 | 0 | 10 | 10 | 2 | 0.6 | 1.6 | Good | I.E. |
| 230 | 14 | 15 | 0 | 11 | 12 | 3 | 0.1 | 1.3 | Good | I.E. |
| 231 | 12 | 11 | 3 | 9 | 8 | 6 | 5.2 | 4.1 | Good | I.E. |
| 232 | 13 | 12 | 2 | 10 | 10 | 4 | 4.7 | 3.6 | Good | I.E. |
| 233 | 14 | 15 | 1 | 11 | 10 | 4 | 4.2 | 3.3 | Good | I.E. |
| 234 | 15 | 16 | 0 | 12 | 12 | 3 | 3.9 | 3 | Good | I.E. |

TABLE 46

| Sample No. | Steel No. | $Ar_3$ (° C.) | ϵ* | Rolling rate (1*) | Coefficient of friction (2*) | FT (° C.) | CT (° C.) | Cold rolling rate (%) | Maximum temperature (° C.) | TS (MPa) | E (RD) (GPa) | E (D) (GPa) | E (TD) (GPa) | Surface layer Young's modulus in rolling direction (GPa) | Surface layer Young's modulus in transverse direction (GPa) |
|---|---|---|---|---|---|---|---|---|---|---|---|---|---|---|---|
| 235 | P5 | 783 | 0.65 | Suitable | Suitable | 850 | 550 | 30 | 800 | 590 | 239 | 205 | 236 | 249 | 247 |
| 236 | | | 0.68 | Suitable | Suitable | 850 | 550 | 60 | 780 | 585 | 242 | 205 | 238 | 257 | 255 |
| 237 | | | 0.72 | Suitable | Suitable | 860 | 550 | 95 | 800 | 580 | 205 | 195 | 234 | 204 | 223 |
| 238 | | | 0.53 | Suitable | Suitable | 870 | 550 | 40 | 960 | 598 | 205 | 210 | 216 | 205 | 210 |
| 239 | | | 0.59 | Suitable | Suitable | 870 | 550 | 70 | 450 | 976 | 219 | 200 | 230 | 230 | 225 |
| 240 | P8 | 762 | 0.55 | Suitable | Suitable | 840 | 550 | 50 | 770 | 789 | 239 | 196 | 234 | 250 | 253 |
| 241 | | | 0.68 | Suitable | Suitable | 860 | 550 | 60 | 780 | 820 | 242 | 205 | 237 | 253 | 249 |
| 242 | | | 0.67 | Suitable | Suitable | 860 | 550 | 90 | 800 | 826 | 205 | 189 | 235 | 218 | 230 |
| 243 | | | 0.69 | Suitable | Suitable | 850 | 550 | 40 | 980 | 795 | 205 | 205 | 209 | 208 | 216 |

TABLE 47

| | Texture in the ⅛ sheet thickness layer | | | Texture in the sheet thickness center layer | | | Spring | Wall | | |
|---|---|---|---|---|---|---|---|---|---|---|
| Sample No. | {110} <223> | {110} <111> | {110} <001> | {211} <011> | {332} <113> | {100} <011> | back (°) | camber (1000/ρ) | Shape fixability | Remarks |
| 235 | 10 | 11 | 1 | 9 | 8 | 4 | 2.6 | 2.6 | Good | I.E. |
| 236 | 11 | 12 | 2 | 9 | 9 | 3 | 2.5 | 2.5 | Good | I.E. |
| 237 | 2 | 3 | 0 | 8 | 7 | 11 | 4.5 | 4.1 | Poor | C.E. |
| 238 | 4 | 4 | 3 | 5 | 6 | 6 | 4.5 | 3.8 | Poor | C.E. |
| 239 | 5 | 6 | 3 | 6 | 4 | 8 | * | * | Poor | C.E. |
| 240 | 12 | 11 | 3 | 9 | 8 | 2 | 5.4 | 3.5 | Good | I.E. |
| 241 | 13 | 12 | 1 | 9 | 9 | 6 | 5.8 | 3.7 | Good | I.E. |
| 242 | 4 | 4 | 0 | 5 | 3 | 4 | 8.5 | 6.3 | Poor | C.E. |
| 243 | 1 | 1 | 3 | 5 | 3 | 2 | 7.9 | 5.8 | Poor | C.E. |

INDUSTRIAL APPLICABILITY

The steel sheet having high Young's modulus according to the present invention may be used in automobiles, household electronic devices, and construction materials, for example. The steel sheet having high Young's modulus according to the present invention includes narrowly defined hot rolled steel sheets and cold rolled steel sheets that are not subjected to surface processing, as well as broadly defined hot rolled steel sheets and cold rolled steel sheets that are subjected to surface processing such as hot-dip galvanization, alloyed hot-dip galvanization, and electroplating, for example, for the purpose of preventing rust. Aluminum-based plating is also included. Steel sheets in which an organic film, an inorganic film, or paint, for example, is present on the surface of a hot rolled steel sheet, a cold rolled steel sheet, or various types of plated steel sheets, as well as steel sheets that combine a plurality of these, are also included.

Because the steel sheet having high Young's modulus of the invention is a steel sheet that has a high Young's modulus, its thickness can be reduced compared to that of the steel sheets to date, and as a result, it can be made lighter. Consequently, it can contribute to protection of the global environmental.

The steel sheet having high Young's modulus of the present invention has improved shape fixability, and can easily be adopted as a high-strength steel sheet for pressed components such as automobile components. Additionally, the steel sheet of the present invention has an excellent ability to absorb collision energy, and thus it also contributes to improving automobile safety.

The invention claimed is:

1. A steel sheet having high Young's modulus, comprising, in terms of mass %, C: 0.0005 to 0.30%, Si: 2.5% or less, Mn: 3.01 to 4.34%, P: 0.15% or less, S: 0.015% or less, Mo: 0.15 to 1.5%, B: 0.0006 to 0.01%, and Al: 0.15% or less, with the remainder being Fe and unavoidable impurities, wherein one or both of {110}<223> pole density and {110}<111> pole density in the ⅛ sheet thickness layer is 10 or more, and a Young's modulus in a rolling direction is more than 230 GPa.

2. The steel sheet having high Young's modulus according to claim 1, wherein the {112}<110> pole density in the ½ sheet thickness layer is 6 or more.

3. The steel sheet having high Young's modulus according to claim 1, which further comprises one or two of Ti: 0.001 to 0.20 mass % and Nb: 0.001 to 0.20 mass %.

4. The steel sheet having high Young's modulus according to claim 1, wherein a BH amount (MPa), which is evaluated by the value obtained by subtracting a flow stress when stretched 2% from an upper yield point when, after stretched 2%, the steel sheet is heat treated at 170° C. for 20 minutes and then a tensile test is performed again, is in a range from 5 MPa or more to 200 MPa or less.

5. The steel sheet having high Young's modulus according to claim 1, which further comprises Ca: 0.0005 to 0.01 mass %.

6. The steel sheet having high Young's modulus according to claim 1, which further comprises one or two or more of Sn, Co, Zn, W, Zr, V, Mg, and REM at a total content of 0.001 to 1.0 mass %.

7. The steel sheet having high Young's modulus according to claim 1, which further comprises one or two or more of Ni, Cu, and Cr at a total content of 0.001 to 4.0 mass %.

8. A hot-dip galvanized steel sheet comprising: the steel sheet having high Young's modulus according to claim 1; and hot-dip zinc plating that is applied to the steel sheet having high Young's modulus.

9. An alloyed hot-dip galvanized steel sheet comprising: the steel sheet having high Young's modulus according to claim 1; and alloyed hot-dip zinc plating that is applied to the steel sheet having high Young's modulus.

10. A steel pipe having high Young's modulus comprising the steel sheet having high Young's modulus according to claim 1, wherein the steel sheet having high Young's modulus is curled in any direction.

* * * * *